US009029303B2

(12) United States Patent
Matsui et al.

(10) Patent No.: US 9,029,303 B2
(45) Date of Patent: May 12, 2015

(54) LUBRICANT OIL COMPOSITION

(75) Inventors: Shigeki Matsui, Tokyo (JP); Akira Yaguchi, Tokyo (JP); Reiko Kudo, Tokyo (JP)

(73) Assignee: JX Nippon Oil & Energy Corporation, Tokyo (JP)

( * ) Notice: Subject to any disclaimer, the term of this patent is extended or adjusted under 35 U.S.C. 154(b) by 415 days.

(21) Appl. No.: 13/322,975

(22) PCT Filed: May 31, 2010

(86) PCT No.: PCT/JP2010/059196

§ 371 (c)(1),
(2), (4) Date: Nov. 29, 2011

(87) PCT Pub. No.: WO2010/140562

PCT Pub. Date: Dec. 9, 2010

(65) Prior Publication Data

US 2012/0071373 A1 Mar. 22, 2012

(30) Foreign Application Priority Data

Jun. 4, 2009 (JP) ..... 2009-135377
Jun. 4, 2009 (JP) ..... 2009-135452

(51) Int. Cl.
*C10M 163/00* (2006.01)
*C10M 145/14* (2006.01)
*C10M 171/00* (2006.01)

(52) U.S. Cl.
CPC ..... *C10M 171/00* (2013.01); *C10M 145/14* (2013.01); *C10M 2203/1006* (2013.01); *C10M 2203/1025* (2013.01); *C10M 2205/04* (2013.01); *C10M 2207/289* (2013.01); *C10M 2209/084* (2013.01); *C10M 2215/102* (2013.01); *C10M 2219/068* (2013.01); *C10N 2210/06* (2013.01); *C10N 2220/027* (2013.01); *C10N 2230/02* (2013.01); *C10N 2230/04* (2013.01); *C10N 2230/10* (2013.01); *C10N 2230/54* (2013.01); *C10N 2230/68* (2013.01); *C10N 2230/74* (2013.01); *C10N 2240/102* (2013.01); *C10N 2240/104* (2013.01)

(58) Field of Classification Search
CPC ..... C10M 2205/173; C10M 2209/084; C10M 2219/068
USPC ..... 508/364, 469
See application file for complete search history.

(56) References Cited

U.S. PATENT DOCUMENTS

| | | | |
|---|---|---|---|
| 2,861,941 | A | 11/1958 | Jancosek et al. |
| 2,890,161 | A | 6/1959 | Brown et al. |
| 3,078,222 | A | 2/1963 | Henke et al. |
| 3,847,790 | A | 11/1974 | Putz |
| 4,021,357 | A | 5/1977 | Morduchowitz et al. |
| 4,867,894 | A | 9/1989 | Pennewiss et al. |
| 5,282,958 | A | 2/1994 | Santilli et al. |
| 5,362,378 | A | 11/1994 | Borghard et al. |
| 5,652,201 | A | 7/1997 | Papay et al. |
| 5,763,374 | A | 6/1998 | Sakai et al. |
| 5,955,405 | A | 9/1999 | Liesen et al. |
| 6,077,455 | A | 6/2000 | Bloch et al. |
| 6,090,989 | A | 7/2000 | Trewella et al. |
| 6,383,366 | B1 | 5/2002 | Riley et al. |
| 6,602,402 | B1 | 8/2003 | Benazzi et al. |
| 7,285,206 | B2 | 10/2007 | Germaine |
| 7,867,957 | B2 | 1/2011 | Matsui et al. |
| 2001/0056044 | A1 | 12/2001 | Kinker et al. |
| 2002/0119896 | A1 | 8/2002 | Yagishita et al. |
| 2003/0036488 | A1 | 2/2003 | Yuki et al. |
| 2003/0104955 | A1 | 6/2003 | Yuki et al. |
| 2003/0162673 | A1 | 8/2003 | Kurihara et al. |
| 2003/0226785 | A1 | 12/2003 | Murphy et al. |
| 2004/0045868 | A1 | 3/2004 | Germaine |
| 2004/0065588 | A1 | 4/2004 | Genetti et al. |
| 2004/0077509 | A1 | 4/2004 | Yuki et al. |
| 2004/0079675 | A1 | 4/2004 | Germaine et al. |
| 2004/0092409 | A1 | 5/2004 | Liesen |
| 2004/0099571 | A1 | 5/2004 | Germaine et al. |
| 2004/0108249 | A1 | 6/2004 | Cody et al. |
| 2004/0112792 | A1 | 6/2004 | Murphy et al. |
| 2004/0119046 | A1 | 6/2004 | Carey et al. |
| 2004/0129603 | A1 | 7/2004 | Fyfe et al. |
| 2004/0154957 | A1 | 8/2004 | Keeney et al. |
| 2004/0154958 | A1 | 8/2004 | Alexander et al. |
| 2004/0198616 | A1 | 10/2004 | Hirao et al. |

(Continued)

FOREIGN PATENT DOCUMENTS

| | | |
|---|---|---|
| CA | 2 682 660 | 10/2008 |
| CN | 1279708 | 1/2001 |

(Continued)

OTHER PUBLICATIONS

International Search Report for PCT/JP2010/059196, Dated: Aug. 31, 2010.

International Preliminary Report on Patentability for PCT/JP2010/059196, Dated: Jan. 26, 2012.

U.S. Appl. No. 13/375,061 to Akira Yaguchi et al., filed Nov. 29, 2011.

(Continued)

*Primary Examiner* — Vishal Vasisth
(74) *Attorney, Agent, or Firm* — Greenblum & Bernstein, P.L.C.

(57) ABSTRACT

A lubricant oil composition according to the present invention comprises: a lubricant base oil whose kinematic viscosity at 100° C. is 1 to 20 $mm^2/s$; and a viscosity index improver in which a ratio M1a/M2a of a total area M1a of peaks in a chemical shift between 29-31 ppm to a total area M2a of peaks in a chemical shift between 64-69 ppm based on a total area of all the peaks is not less than 10 in a spectrum obtained by $^{13}C$-NMR.

8 Claims, No Drawings

(56) References Cited

U.S. PATENT DOCUMENTS

| | | | |
|---|---|---|---|
| 2004/0224860 | A1 | 11/2004 | Baba et al. |
| 2005/0077209 | A1 | 4/2005 | Miller et al. |
| 2005/0221998 | A1 | 10/2005 | Marumo et al. |
| 2006/0027486 | A1 | 2/2006 | Rosenbaum et al. |
| 2006/0052252 | A1 | 3/2006 | Wedlock |
| 2006/0172900 | A1 | 8/2006 | Yagishita et al. |
| 2006/0205610 | A1 | 9/2006 | Rosenbaum et al. |
| 2007/0032392 | A1 | 2/2007 | Yokoyama et al. |
| 2007/0138032 | A1 | 6/2007 | Agarkov |
| 2007/0138052 | A1 | 6/2007 | Kobayashi et al. |
| 2007/0191239 | A1 | 8/2007 | Matsuoka et al. |
| 2007/0238627 | A1 | 10/2007 | Haire et al. |
| 2007/0287643 | A1 | 12/2007 | Matsui et al. |
| 2008/0015400 | A1 | 1/2008 | Matsui et al. |
| 2008/0029430 | A1 | 2/2008 | Loh et al. |
| 2008/0029431 | A1 | 2/2008 | Alexander et al. |
| 2008/0110799 | A1 | 5/2008 | Matsui et al. |
| 2008/0248981 | A1 | 10/2008 | Matsui et al. |
| 2009/0005278 | A1 | 1/2009 | Takeuchi et al. |
| 2009/0075852 | A1 | 3/2009 | Yagishita et al. |
| 2009/0221461 | A1 | 9/2009 | Visger et al. |
| 2009/0312208 | A1 | 12/2009 | Ishikawa et al. |
| 2010/0016195 | A1 | 1/2010 | Shirahama et al. |
| 2010/0035777 | A1 | 2/2010 | Sano et al. |
| 2010/0041572 | A1 | 2/2010 | Sano et al. |
| 2010/0093578 | A1 | 4/2010 | Tsujimoto et al. |
| 2010/0130395 | A1 | 5/2010 | Tagawa et al. |
| 2010/0144571 | A1 | 6/2010 | Shirahama et al. |
| 2010/0190671 | A1 | 7/2010 | Stoehr et al. |
| 2011/0003725 | A1 | 1/2011 | Matsui et al. |
| 2011/0021394 | A1 | 1/2011 | Nakao et al. |
| 2011/0042267 | A1 | 2/2011 | Hayasaka |
| 2011/0049008 | A1 | 3/2011 | Tagawa et al. |
| 2011/0049009 | A1 | 3/2011 | Tagawa et al. |
| 2011/0053815 | A1 | 3/2011 | Matsui et al. |
| 2011/0065618 | A1 | 3/2011 | Tagawa |
| 2011/0124536 | A1 | 5/2011 | Matsui |
| 2011/0218131 | A1 | 9/2011 | Tsujimoto et al. |
| 2011/0230685 | A1 | 9/2011 | Tagawa |
| 2011/0237477 | A1 | 9/2011 | Tagawa et al. |
| 2011/0306530 | A1 | 12/2011 | Manabe et al. |
| 2012/0071373 | A1 | 3/2012 | Matsui et al. |
| 2012/0071374 | A1 | 3/2012 | Yaguchi et al. |
| 2012/0071375 | A1 | 3/2012 | Yaguchi et al. |

FOREIGN PATENT DOCUMENTS

| | | | |
|---|---|---|---|
| CN | 1751115 | | 3/2006 |
| CN | 1317368 | C | 5/2007 |
| CN | 101065469 | | 10/2007 |
| CN | 101213277 | | 7/2008 |
| CN | 101426879 | | 5/2009 |
| EP | 1 798 278 | | 10/2006 |
| EP | 1 749 876 | | 2/2007 |
| EP | 2 009 074 | | 3/2007 |
| EP | 1 808 476 | | 7/2007 |
| EP | 1 845 151 | | 10/2007 |
| EP | 2 011 855 | | 8/2008 |
| EP | 2 009 074 | | 12/2008 |
| EP | 2 009 704 | | 12/2008 |
| EP | 2 011 854 | | 1/2009 |
| EP | 2 112 217 | | 10/2009 |
| EP | 2135928 | | 12/2009 |
| EP | 2 241 611 | | 10/2010 |
| EP | 2 251 402 | | 11/2010 |
| EP | 2264131 | | 12/2010 |
| EP | 2264133 | | 12/2010 |
| EP | 2 319 908 | | 5/2011 |
| GB | 2407100 | | 4/2005 |
| JP | S30-000624 | | 2/1955 |
| JP | S31-003928 | | 5/1956 |
| JP | S45-019183 | | 7/1970 |
| JP | 63-223094 | | 9/1988 |
| JP | S63-309592 | | 12/1988 |
| JP | 3-100099 | | 4/1991 |
| JP | 4-30391 | | 2/1992 |
| JP | 4-036391 | | 2/1992 |
| JP | 4-68082 | | 3/1992 |
| JP | 4-120193 | | 4/1992 |
| JP | H5-508876 | | 12/1993 |
| JP | 6-145258 | | 5/1994 |
| JP | 6-306384 | A | 11/1994 |
| JP | 7-048421 | | 2/1995 |
| JP | 7-062372 | | 3/1995 |
| JP | 8-183988 | | 7/1996 |
| JP | 8-302378 | A | 11/1996 |
| JP | 9-003463 | | 1/1997 |
| JP | 2000-063439 | | 2/2000 |
| JP | 2000-63877 | | 2/2000 |
| JP | 2000-345170 | | 12/2000 |
| JP | 2000-345171 | | 12/2000 |
| JP | 2001-514301 | | 9/2001 |
| JP | 2001-279278 | | 10/2001 |
| JP | 2001-279287 | A | 10/2001 |
| JP | 2002-12884 | | 1/2002 |
| JP | 2002-503754 | | 2/2002 |
| JP | 2002-503755 | | 2/2002 |
| JP | 2002-129182 | A | 5/2002 |
| JP | 2002-521499 | | 7/2002 |
| JP | 2002-220597 | | 8/2002 |
| JP | 2002-302687 | | 10/2002 |
| JP | 2003-292938 | | 10/2003 |
| JP | 2004-10799 | | 1/2004 |
| JP | 2004-124080 | | 4/2004 |
| JP | 2004-169029 | | 6/2004 |
| JP | 2004-526831 | | 9/2004 |
| JP | 2004-528426 | | 9/2004 |
| JP | 2005-154760 | | 6/2005 |
| JP | 2005-171186 | | 6/2005 |
| JP | 2005-213447 | | 8/2005 |
| JP | 2005-290238 | | 10/2005 |
| JP | 2005-530902 | | 10/2005 |
| JP | 2006-502297 | | 1/2006 |
| JP | 2006-502298 | | 1/2006 |
| JP | 2006-045277 | | 2/2006 |
| JP | 2006-509899 | | 3/2006 |
| JP | 2006-117851 | | 5/2006 |
| JP | 2006-117853 | | 5/2006 |
| JP | 2006-219642 | | 8/2006 |
| JP | 2006-518395 | | 8/2006 |
| JP | 2006-241436 | | 9/2006 |
| JP | 2006-241437 | | 9/2006 |
| JP | 2006-521416 | | 9/2006 |
| JP | 2006-274209 | | 10/2006 |
| JP | 2007-016172 | | 1/2007 |
| JP | 2007-45850 | A | 2/2007 |
| JP | 2007-84826 | | 4/2007 |
| JP | 2007-162026 | | 6/2007 |
| JP | 2007-217494 | | 8/2007 |
| JP | 2007-246659 | | 9/2007 |
| JP | 2007-246661 | | 9/2007 |
| JP | 2007-246662 | | 9/2007 |
| JP | 2007-262239 | | 10/2007 |
| JP | 2007-269885 | | 10/2007 |
| JP | 2007-270059 | | 10/2007 |
| JP | 2007-270062 | | 10/2007 |
| JP | 2007-284635 | | 11/2007 |
| JP | 2007-297528 | | 11/2007 |
| JP | 2007-326963 | | 12/2007 |
| JP | 2008-013281 | | 1/2008 |
| JP | 2008-13681 | | 1/2008 |
| JP | 2008-013684 | | 1/2008 |
| JP | 2008-031459 | | 2/2008 |
| JP | 2008-509244 | | 3/2008 |
| JP | 2008-120908 | | 5/2008 |
| JP | 2008-120909 | | 5/2008 |
| JP | 2008-184569 | | 8/2008 |
| JP | 2008-231189 | | 10/2008 |
| JP | 2008-231190 | | 10/2008 |
| JP | 2008-231191 | | 10/2008 |
| JP | 2008-274236 | | 11/2008 |
| JP | 2008-274237 | | 11/2008 |
| JP | 2008-274238 | | 11/2008 |

(56) References Cited

FOREIGN PATENT DOCUMENTS

| | | | |
|---|---|---|---|
| JP | 2008-303344 | | 12/2008 |
| JP | 2009-74068 | | 4/2009 |
| JP | 2009-96925 | | 5/2009 |
| JP | 2009-167278 | | 7/2009 |
| JP | 2009-191247 | | 8/2009 |
| JP | 2010-532805 | | 10/2010 |
| WO | 9603359 | | 2/1996 |
| WO | 99/41334 | | 8/1999 |
| WO | 02/070629 | | 9/2002 |
| WO | 2005/037967 | | 4/2005 |
| WO | 2005/090528 | | 9/2005 |
| WO | 2006/043709 | | 4/2006 |
| WO | 2007/001000 | | 1/2007 |
| WO | 2007/105769 | | 9/2007 |
| WO | 2007/114132 | | 10/2007 |
| WO | 2007/114260 | | 10/2007 |
| WO | 2007/116759 | A1 | 10/2007 |
| WO | 2007/119299 | | 10/2007 |
| WO | 2007/123266 | | 11/2007 |
| WO | 2007/133999 | | 11/2007 |
| WO | 2008/072526 | | 6/2008 |
| WO | 2008/093446 | A1 | 8/2008 |
| WO | 2008/123246 | | 10/2008 |
| WO | 2008/123249 | | 10/2008 |
| WO | 2009/007147 | | 1/2009 |
| WO | 2009/072524 | | 6/2009 |
| WO | 2009/090921 | | 7/2009 |
| WO | 2009/119505 | | 10/2009 |
| WO | 2010/041689 | | 4/2010 |
| WO | 2010/041692 | | 4/2010 |

OTHER PUBLICATIONS

U.S. Appl. No. 13/375,122 to Akira Yaguchi et al., filed Nov. 29, 2011.
U.S. Appl. No. 13/375,365 to Shigeki Matsui et al., filed Nov. 30, 2011.
U.S. Appl. No. 13/392,189 to Akio Mutou et al., filed Feb. 24, 2012.
Office Action issued with respect to U.S. Appl. No. 13/122,828, mailed Feb. 28, 2013.
Office Action issued with respect to U.S. Appl. No. 12/934,374, mailed Mar. 25, 2013.
Office Action issued with respect to U.S. Appl. No. 13/122,622, mailed Mar. 22, 2013.
Hiroshi Ohtsuka et al., "Separation of Straight—Chain Hydrocarbons from Petroleum Fractions by Means of Urea—Adduct Formation", Bulletin of the Faculty of Engineering, Hokkaido University, 40, Mar. 30, 1966, pp. 125-137, along with a partial English-language translation.
Yozo Oshima et al., "Monomethylparaffins in n—Paraffins Adducted from Petroleum Fractions", Sekiyu Gakkaishi, vol. 18, No. 6, 1975, pp. 497-502, along with a partial English-language translation.
International Search report for PCT/JP2010/064698 (English and Japanese) , mailed Nov. 2, 2010.
English language version of International Preliminary Report on Patentability for PCT/JP2010/064698, mailed Mar. 29, 2012.
Office Action issued with respect to Chinese Patent Application No. 200980110123.8, mailed Apr. 1, 2013.
Schiessler et al., "Urea and Thiourea Adduction of $C_5$-$C_{42}$-Hydrocarbons", *Journal of the American Chemical Society*, vol. 74, No. 7, pp. 1720-1723, Apr. 5, 1952.
Japanese Office Action issued with respect to Japanese Patent Appl. No. 2009-135369, dated Jul. 16, 2013.
Japanese Office Action issued with respect to Japanese Patent Application No. 2008-261070, dated Jul. 2, 2013.
E.P.O. Office action issued with respect to European Patent Application No. 09723908.1, mailed Mar. 2, 2012.
English-language translation of International Preliminary Report on Patentability for PCT/JP2009/0067163, mailed May 26, 2011.
English-language translation of International Preliminary Report on Patentability for PCT/JP2009/055667, mailed Nov. 18, 2010.
English-language translation of International Preliminary Report on Patentability for PCT/JP2009/067504, mailed May 26, 2011.
English-language translation of International Preliminary Report on Patentability for PCT/JP2009/067509, mailed May 26, 2011.
English-language translation of International Preliminary Report on Patentability for PCT/JP2010/050916, mailed Jan. 26, 2012.
English-language translation of International Preliminary Report on Patentability for PCT/JP2010/050921, mailed Jan. 26, 2012.
English-language translation of International Preliminary Report on Patentability for PCT/JP2010/057957, mailed Jan. 26, 2012.
International Search Report for PCT/JP2009/0067504, mailed Dec. 28, 2009.
International Search Report for PCT/JP2009/055667, mailed Jun. 16, 2009.
International Search Report for PCT/JP2010/050916, mailed Apr. 13, 2010.
International Search Report for PCT/JP2010/050921, mailed Apr. 6, 2010.
International Search Report for PCT/JP2010/057957, mailed Aug. 17, 2010.
E.P.O. Search Report that issued with respect to European Patent Application No. 09723908.1, mailed Jun. 29, 2011.
Sharma et al., "Predicting Low Temperature Lubricant Rheology Using Nuclear Magnetic Resonance Spectroscopy and Mass Spectrometry ", Tribology Letters, vol. 16, No. 1-2, Feb. 2004, pp. 11-19.
Shinya Sato et al., "Separation of n-Paraffin and 1-Olefin in Shale Oil by Urea Adduct Method", Sekiyu Gakkaishi, vol. 39, No. 5, 1996, pp. 365-368 with partial English language translation.
English-language translation of International Preliminary Report on Patentability for PCT/JP2009/050233, mailed Jul. 29, 2010.
E.P.O. Search Report issued with respect to European Patent Application No. 09819226.3, mailed Jun. 21, 2012.
E.P.O. Search Report issued with respect to European Patent Application No. 09701700.8, mailed Jul. 5, 2012.
Search Report issued with respect to European Patent Application No. 10783178.6, mailed Oct. 29, 2012.
English-language translation of International Preliminary Report on Patentability issued with respect to PCT/JP2009/055666, mailed Nov. 18, 2010.
English-language translation of International Preliminary Report on Patentability issued with respect to PCT/JP2009/055690, mailed Nov. 18, 2010.
Office Action issued with respect to U.S. Appl. No. 12/812,524, mailed Aug. 28, 2012.
Office Action issued with respect to Chinese Patent Application No. 200980110123.8, mailed Aug. 31, 2012.
Office Action issued with respect to Chinese Patent Application No. 200980110437.8, mailed Aug. 31, 2012.
Office Action issued with respect to European Patent Application No. 09723908.1, mailed Sep. 12, 2012.
Zimmerschied et al., "Crystalline Adducts of Urea with Linear Aliphatic Compounds", Industrial and Engineering Chemistry 42(7), Jul. 31, 1950, pp. 1300-1306.
Rowe et al., "Low-Temperature Performance Advantages for Oils Using Hydrodewaxed Base Stocks", SAE Technical Paper Series 831715, Jan. 1, 1983, pp. 1-14.
Speight, "Hydrocarbons from Petroleum", Handbook of Industrial Hydrocarbon Processes, Jan. 1, 2011, pp. 85-126.
Search Report issued with respect to European Patent Application No. 10783230.5, mailed Feb. 11, 2013.
Search Report issued with respect to European Patent Application No. 12008549.3, mailed Feb. 11, 2013.
Search Report issued with respect to European Patent Application No. 12002743.8, mailed Aug. 16, 2012.
Search Report issued with respect to European Patent Application No. 12002744.6, mailed Aug. 16, 2012.
Office Action issued with respect to Indonesian Patent Application No. W00201003649, mailed Aug. 23, 2012.
Office Action issued with respect to Japanese Patent Application No. 2008-006024, mailed Dec. 4, 2012.
Office Action issued with respect to U.S. Appl. No. 12/812,524, mailed Jan. 22, 2013.

(56) References Cited

OTHER PUBLICATIONS

Japanese Office Action issued with respect to Japanese Patent Application No. 2008-261079, dated May 21, 2013.
Office Action issued with respect to Chinese Patent Application No. 200980149130.9, mailed Dec. 4, 2012.
Office Action issued with respect to Chinese Patent Application No. 201080024425.6, mailed Dec. 12, 2012.
Office Action issued with respect to patent family member Chinese Patent Application No. 201080024832.7, mailed Dec. 12, 2012.
Extended European Search Report issued with respect to European Patent Application No. 10783345 1, mailed Feb. 12, 2014.
Extended European Search report issued in respect to European patent Application No. 10842116.5, mailed Feb. 12, 2014.
Notification of Information Provision of EP 10842116.5, mailed May 28, 2014.
International Search Report of PCT/JP2010/066708, mailed Dec. 28, 2010.
International Preliminary Search Report of PCT/JP2010/066708, mailed Aug. 23, 2012.
Office Action issued in respect to U.S. Appl. No. 12/812,524, mailed Aug. 28, 2012.
Search Report of European Patent Application No. 12002743.8, mailed Aug. 16, 2012.
Search Report of European Patent Application No. 12002744.6, mailed Aug. 16, 2012.
International Preliminary Report on Patentability for PCT/JP2010/050916, mailed Jan. 26, 2012.
U.S. Appl. No. 13/322,974 to Matsui et al., dated Nov. 29, 2011.
Tsuyoshi, Yuki, "Technologies for Inproving Lubricating Performances in Viscosity Index Improver for Low Viscosity Lubricants," Tribologists, vol. 53, No. 7, 2008, p. 449-455; along with a partial English translation.
Hideo, Tanaka, "Viscosity Index Improver," Tribologists, vol. 52, No. 11, 2007, p. 789-792; along with a partial English translation.
U.S. Appl. No. 13/520,679, filed Jul. 5, 2012.
"The Advent of Modern Hydroprocessing—The Evolution of Base Oil Technology—Part 2", Machinery Lubirication (Retrieved from: http://www.machinerylubrication.com/Read/493/base-oil-technology on May 14, 2012), May 1, 2003, XP55027093.
Search report from E.P.O. that issued with respect to European Patent Application No. 09819126.5, mailed May 23, 2012.
Search report from E.P.O. that issued with respect to European Patent Application No. 09819223.0, mailed May 23, 2012.

LUBRICANT OIL COMPOSITION

This application is a 371 of PCT/JP2010/059196, filed May 31, 2010.

TECHNICAL FIELD

The present invention relates to a lubricant oil composition.

BACKGROUND ART

Lubricant oils are used for internal combustion engines, transmissions, and other machinery in order to smooth the action. Particularly, high performance is demanded of the lubricant oils for internal combustion engines (engine oils) along with higher performance and higher output of the internal combustion engines, and severer operation conditions, and the like. Accordingly, in order to satisfy such required performances, a variety of additives such as a wear-resistant agent, a metallic detergent, an ash-free dispersant, and an antioxidant are blended with the conventional engine oil (see Patent Literatures 1 to 3 below, for example.). Recently, a demand for fuel efficiency performance of the lubricant oil has been increased more and more, and use of a high viscosity index base oil or use of a variety of friction modifiers has been examined (see Patent Literature 4 below, for example.).

CITATION LIST

Patent Literature

[Patent Literature 1] Japanese Patent Application Laid-Open Publication No. 2001-279287
[Patent Literature 2] Japanese Patent Application Laid-Open Publication No. 2002-129182
[Patent Literature 3] Japanese Patent Application Laid-Open Publication No. 08-302378
[Patent Literature 4] Japanese Patent Application Laid-Open Publication No. 06-306384

SUMMARY OF INVENTION

Technical Problem

It cannot be said, however, that the conventional lubricant oil is sufficient from the viewpoint of fuel efficiency.

For example, as a conventional method for reducing fuel consumption, reduction in kinematic viscosity and improvement in a viscosity index of the lubricant oil (multi-grading by a combination of a low viscosity base oil with a viscosity index improver) are known. In this case, however, reduction in the viscosity of the lubricant oil or the base oil that forms the lubricant oil may cause the lubricating performance to be reduced under a severe lubricant condition (under a high temperature high shear condition), resulting in malfunctions such as wear, seizure, and fatigue breaking. Namely, in the conventional lubricant oil, it is difficult to give sufficient fuel efficiency while other practical performances such as durability are kept.

Moreover, in order to prevent the malfunctions above and give fuel efficiency while the durability is kept, it is effective that an HTHS viscosity at 150° C. ("HTHS viscosity" is also referred to as a "high temperature high shear viscosity.") is higher while a kinematic viscosity at 40° C., a kinematic viscosity at 100° C., and an HTHS viscosity at 100° C. are lower, and low temperature viscosity properties are improved; however, it is very difficult for the conventional lubricant oil to satisfy all the requirements.

The present invention has been made in consideration of such a situation, and an object of the present invention is to provide a lubricant oil composition whose HTHS viscosity at 150° C. is sufficiently high, kinematic viscosity at 40° C., kinematic viscosity at 100° C., and HTHS viscosity at 100° C. are sufficiently low, and low temperature viscosity properties are high.

Solution to Problem

In order to solve the problem, the present invention provides a lubricant oil composition (hereinafter, referred to as a "first lubricant oil composition" for convenience) comprising: a lubricant base oil whose kinematic viscosity at 100° C. is 1 to 20 $mm^2/s$; and a viscosity index improver in which a ratio M1a/M2a of a total area M1a of peaks in a chemical shift between 29-31 ppm to a total area M2a of peaks in a chemical shift between 64-69 ppm based on a total area of all the peaks is not less than 10 in a spectrum obtained by $^{13}C$-NMR.

It is preferable that the viscosity index improver contained in the first lubricant oil composition be a poly(meth)acrylate viscosity index improver.

Further, it is preferable that the viscosity index improver be a viscosity index improver whose PSSI is not more than 40, and ratio of a weight-average molecular weight to the PSSI is not less than $1\times10^4$.

Here, the "PSSI" in the present invention means a permanent shear stability index (Permanent Shear Stability Index) of a polymer calculated on the data measured according to ASTM D 6022-01 (Standard Practice for Calculation of Permanent Shear Stability Index) by ASTM D 6278-02 (Test Method for Shear Stability of Polymer Containing Fluids Using a European Diesel Injector Apparatus).

It is also preferable that the first lubricant oil composition further comprises at least one friction modifier selected from organic molybdenum compounds and ash-free friction modifiers.

The present invention also provides a lubricant oil composition (hereinafter, referred to as a "second lubricant oil composition" for convenience) comprising: a lubricant base oil whose kinematic viscosity at 100° C. is 1 to 5 $mm^2/s$; and a viscosity index improver in which a ratio M1/M2b of a total area M1of peaks in a chemical shift between 51-52.5 ppm to a total area M2b of peaks in a chemical shift between 64-66 ppm based on a total area of all the peaks is not less than 0.50 in a spectrum obtained by $^{13}C$-NMR, wherein a ratio of an HTHS viscosity at 150° C. to an HTHS viscosity at 100° C. satisfies a condition represented by the following equation (A):

$$\text{HTHS (150° C.)}/\text{HTHS (100° C.)} \geq 0.50 \quad \text{(A)}$$

wherein HTHS (100° C.) represents the HTHS viscosity at 100° C., and HTHS (150° C.) represents the HTHS viscosity at 150° C.

The "HTHS viscosity at 150° C." and "HTHS viscosity at 100° C." in the present invention mean the high temperature high shear viscosity at 150° C. and that at 100° C. specified by ASTM D 4683, respectively.

It is preferable that the viscosity index improver contained in the second lubricant oil composition be a poly(meth)acrylate viscosity index improver.

Further, it is preferable that the viscosity index improver be a viscosity index improver whose PSSI is not more than 40, and ratio of a weight-average molecular weight to the PSSI is not less than $0.8\times10^4$.

It is also preferable that in the second lubricant oil composition, the HTHS viscosity at 150° C. be not less than 2.6, and the HTHS viscosity at 100° C. be not more than 5.3.

Advantageous Effects of Invention

The first and second lubricant oil compositions according to the present invention are compositions in which the HTHS viscosity at 150° C. is sufficiently high, the kinematic viscosity at 40° C., kinematic viscosity at 100° C., and HTHS viscosity at 100° C. are sufficiently low, and further the low temperature viscosity properties are high. Accordingly, according to the first and second lubricant oil compositions, without using a synthetic oil such as a poly-α-olefin base oil and an ester base oil or a low viscosity mineral base oil, fuel efficiency can be significantly improved while the HTHS viscosity at 150° C. is kept; particularly, the HTHS viscosity at 100° C. and kinematic viscosities at 40° C. and 100° C. of the lubricant oil can be significantly reduced to remarkably improve the fuel efficiency.

Moreover, the first and second lubricant oil compositions according to the present invention can be suitably used for gasoline engines, diesel engines, gas engines for two-wheel vehicles, four-wheel vehicles, electric power generation, and cogeneration; further, the first and second lubricant oil compositions according to the present invention can be not only suitably used for the variety of engines using a fuel in which a sulfur content is not more than 50 mass ppm, but also useful in a variety of engines for ships and outboard motors.

DESCRIPTION OF EMBODIMENTS

Hereinafter, suitable embodiments of the present invention will be described in detail.

[First Embodiment]

A lubricant oil composition according to a first embodiment of the present invention is a lubricant oil composition (first lubricant oil composition) comprising: a lubricant base oil whose kinematic viscosity at 100° C. is 1 to 20 $mm^2/s$; and a viscosity index improver in which a ratio M1a/M2a of a total area M1a of peaks in a chemical shift between 29-31 ppm to a total area M2a of peaks in a chemical shift between 64-69 ppm based on a total area of all the peaks is not less than 10 in a spectrum obtained by $^{13}C$-NMR.

In the first embodiment, a lubricant base oil (hereinafter, referred to as the "first lubricant base oil") whose kinematic viscosity at 100° C. is 1 to 20 $mm^2/s$ is used.

The first lubricant base oil is not particularly limited as long as the kinematic viscosity at 100° C. satisfies the condition described above. Specifically, of paraffin mineral oils obtained by refining a lubricant oil fraction obtained by normal pressure distillation and/or reduced pressure distillation of a crude oil by one or two or more of refining treatments selected from solvent deasphalting, solvent extraction, hydrocracking, solvent dewaxing, catalytic dewaxing, hydrorefining, sulfuric acid washing, and clay treatment, or normal paraffin base oils, isoparaffin base oils, and the like, base oils whose kinematic viscosity at 100° C. satisfies the condition described above can be used.

Preferable examples of the first lubricant base oil can include base oils obtained by using base oils (1) to (8) shown below as a raw material, refining the raw material oil and/or a lubricant oil fraction recovered from the raw material oil by a predetermined refining method, and recovering a lubricant oil fraction:

(1) to (8) shown below as a raw material, refining the raw material oil and/or a lubricant oil fraction recovered from the raw material oil by a predetermined refining method, and recovering a lubricant oil fraction:

(1) a distilled oil obtained by normal pressure distillation of a paraffin-base crude oil and/or a mixed-base crude oil, (2) a distilled oil obtained by reduced pressure distillation of a residue of a paraffin-base crude oil and/or a mixed-base crude oil subjected to normal pressure distillation (WVGO), (3) a wax obtained by a lubricant oil dewaxing step (such as slack wax) and/or a synthetic wax obtained by a gas-to-liquid (GTL) process or the like (such as Fischer-Tropsch wax and GTL wax), (4) one selected from the base oils (1) to (3) or a mixed oil of two or more selected from the base oils (1) to (3) and/or a mild hydrocracked oil of the mixed oil, (5) a mixed oil of two or more selected from the base oils (1) to (4), (6) a deasphalted oil of the base oil (1), (2), (3), (4), or (5) (DAO), (7) a mild hydrocracked oil of the base oil (6) (MHC), and (8) a mixed oil of two or more selected from the base oils (1) to (7).

As the predetermined refining method, hydrorefining such as hydrocracking and hydrofinishing; solvent refining such as furfural solvent extraction; dewaxing such as solvent dewaxing and catalytic dewaxing; clay refining using acid clay, activated clay, or the like; and chemical (acid or alkali) washing such as sulfuric acid washing and sodium hydroxide washing are preferable. In the first embodiment, one of these refining methods may be performed alone, or two or more thereof may be performed in combination. In the case where two or more of the refining methods are combined, the order is not particularly limited, and can be properly determined.

Further, as the first lubricant base oil, a base oil (9) or (10) below obtained by performing a predetermined treatment on the base oil selected from the base oils (1) to (8) or a lubricant oil fraction recovered from the base oil is particularly preferable:

(9) a hydrocracked mineral oil obtained by hydrocracking the base oil selected from the base oils (1) to (8) or a lubricant oil fraction recovered from the base oil, performing a dewaxing treatment such as solvent dewaxing and catalytic dewaxing on the product or a lubricant oil fraction recovered from the product by distillation or the like, or performing the dewaxing treatment and distilling the dewaxed product; or

(10) a hydrogenation isomerized mineral oil obtained by hydrogenation isomerizing the base oil selected from the base oils (1) to (8) or a lubricant oil fraction recovered from the base oil, performing a dewaxing treatment such as solvent dewaxing and catalytic dewaxing on the product or a lubricant oil fraction recovered from the product by distillation or the like, or performing the dewaxing treatment and distilling the dewaxed product.

As a convenient step when the lubricant base oil (9) or (10) is obtained, a solvent refining treatment and/or a hydrofinishing treatment step may be further provided when necessary.

The catalyst used for the hydrocracking and hydrogenation isomerization is not particularly limited; preferably used are hydrocracking catalysts in which using a composite oxide having decomposition activity (for example, silica alumina, alumina boria, silica zirconia) or that obtained by binding a combination of one or more of the composite oxides by a binder as a carrier, a metal having a hydrogenation ability (for example, one or more of Group Via metals and Group VIII metals in the periodic table) is supported, or hydrogenation isomerization catalysts in which a metal having a hydrogenation ability and containing at least one or more Group VIII metals is supported by a carrier containing zeolite (for example, ZSM-5, zeolite beta, SAPO-11). The hydrocracking catalyst and the hydrogenation isomerization catalyst may be used in combination by lamination, mixing, or the like.

The reaction condition in hydrocracking and hydrogenation isomerization is not particularly limited, and it is preferable that the hydrogen partial pressure be 0.1 to 20 MPa, the average reaction temperature be 150 to 450° C., the LHSV be 0.1 to 3.0 hr-1, and the ratio of hydrogen/oil be 50 to 20000 scf/b.

The kinematic viscosity at 100° C. of the first lubricant base oil is not more than 20 $mm^2/s$, preferably not more than 10 $mm^2/s$, more preferably not more than 7 $mm^2/s$, still more preferably not more than 5.0 $mm^2/s$, particularly preferably not more than 4.5 $mm^2/s$, and most preferably not more than 4.2 $mm^2/s$. On the other hand, the kinematic viscosity at 100° C. needs to be not less than 1 $mm^2/s$, and is preferably not less than 1.5 $mm^2/s$, more preferably not less than 2 $mm^2/s$, still more preferably not less than 2.5 $mm^2/s$, and particularly preferably not less than 3 $mm^2/s$. The kinematic viscosity at 100° C. in the present invention designates the kinematic viscosity at 100° C. specified by ASTM D-445. In the case where the kinematic viscosity at 100° C. of the lubricant base oil component is more than 10 $mm^2/s$, the low temperature viscosity properties may be reduced, and sufficient fuel efficiency may not be obtained; at a kinematic viscosity at 100° C. of not more than 1 $mm^2/s$, lubricating properties may be poor because oil film formation in a lubricated place is insufficient, and evaporation loss of the lubricant oil composition may be increased.

In the first embodiment, it is preferable that the lubricant base oil whose kinematic viscosity at 100° C. is within the range below be fractionated by distillation or the like, and used:

(I) a lubricant base oil whose kinematic viscosity at 100° C. is not less than 1.5 $mm^2/s$ and less than 3.5 $mm^2/s$, and more preferably 2.0 to 3.0 $mm^2/s$, (II) a lubricant base oil whose kinematic viscosity at 100° C. is not less than 3.5 $mm^2/s$ and less than 4.5 $mm^2/s$, and more preferably 3.5 to 4.1 $mm^2/s$, and (III) a lubricant base oil whose kinematic viscosity at 100° C. is 4.5 to 10 $mm^2/s$, more preferably 4.8 to 9 $mm^2/s$, and particularly preferably 5.5 to 8.0 $mm^2/s$.

The kinematic viscosity at 40° C. of the first lubricant base oil is preferably not more than 80 $mm^2/s$, more preferably not more than 50 $mm^2/s$, still more preferably not more than 20 $mm^2/s$, particularly preferably not more than 19 $mm^2/s$, and most preferably not more than 18 $mm^2/s$. On the other hand, the kinematic viscosity at 40° C. is preferably not less than 6.0 $mm^2/s$, more preferably not less than 8.0 $mm^2/s$, still more preferably not less than 12 $mm^2/s$, particularly preferably not less than 14 $mm^2/s$, and most preferably not less than 15 $mm^2/s$. In the case where the kinematic viscosity at 40° C. of the lubricant base oil component is more than 80 $mm^2/s$, the low temperature viscosity properties may be reduced, and sufficient fuel efficiency may not be obtained; at a kinematic viscosity at 40° C. not more than 6.0 $mm^2/s$, the lubricating properties may be poor because oil film formation in a lubricated place is insufficient, and evaporation loss of the lubricant oil composition may be increased. In the first embodiment, it is also preferable that the lubricant oil fraction whose kinematic viscosity at 40° C. is within the range below be fractionated by distillation or the like, and used:

(IV) a lubricant base oil whose kinematic viscosity at 40° C. is not less than 6.0 $mm^2/s$ and less than 12 $mm^2/s$, and more preferably 8.0 to 12 $mm^2/s$, (V) a lubricant base oil whose kinematic viscosity at 40° C. is not less than 12 $mm^2/s$ and less than 28 $mm^2/s$, and more preferably 13 to 19 $mm^2/s$, and (VI) a lubricant base oil whose kinematic viscosity at 40° C. is 28 to 50 $mm^2/s$, more preferably 29 to 45 $mm^2/s$, and particularly preferably 30 to 40 $mm^2/s$.

It is preferable that the viscosity index of the first lubricant base oil be not less than 120. The viscosity index of the lubricant base oils (I) and (IV) is preferably 120 to 135, and more preferably 120 to 130. The viscosity index of the lubricant base oils (II) and (V) is preferably 120 to 160, more preferably 125 to 150, and still more preferably 130 to 145. The viscosity index of the lubricant base oils (III) and (VI) is preferably 120 to 180, and more preferably 125 to 160. At a viscosity index less than the lower limit, the viscosity-temperature properties, heat and oxidation stabilities, and anti-volatilization tend to be reduced, a coefficient of friction tends to be increased, and wear resistance tends to be reduced. At a viscosity index more than the upper limit, the low temperature viscosity properties tend to be reduced.

The viscosity index in the present invention means a viscosity index measured according to JIS K 2283-1993.

While the density at 15° C. ($\rho_{15}$) of the first lubricant base oil depends on the viscosity grade of the lubricant base oil component, it is preferable that the density at 15° C. be not more than a value $\rho$ represented by the following equation (A), namely, $\rho_{15} \leq \rho$:

$$\rho = 0.0025 \times kv100 + 0.816 \quad (A)$$

wherein kv100 represents the kinematic viscosity at 100° C. of the lubricant base oil component ($mm^2/s$).

If $\rho_{15} > \rho$, the viscosity-temperature properties, heat and oxidation stabilities, anti-volatilization, and low temperature viscosity properties tend to be reduced, and the fuel efficiency may be reduced. In the case where an additive is blended with the lubricant base oil component, the effect of the additive may be reduced.

Specifically, the density at 15° C. ($\rho_{15}$) of the first lubricant base oil is preferably not more than 0.860, more preferably not more than 0.850, still more preferably not more than 0.840, and particularly preferably not more than 0.830.

The density at 15° C. in the present invention means the density measured at 15° C. according to JIS K 2249-1995.

The pour point of the first lubricant base oil depends on the viscosity grade of the lubricant base oil, and for example, the pour point of the lubricant base oils (I) and (IV) is preferably not more than −10° C., more preferably not more than −12.5° C., and still more preferably not more than −15° C. The pour point of the lubricant base oils (II) and (V) is preferably not more than −10° C., more preferably not more than −15° C., and still more preferably not more than −17.5° C. The pour point of the lubricant base oils (III) and (VI) is preferably not more than −10° C., more preferably not more than −12.5° C., and still more preferably not more than −15° C. At a pour point more than the upper limit, the low temperature fluidity of the whole lubricant oil using the lubricant base oil tends to be reduced. The pour point in the present invention means the pour point measured according to JIS K 2269-1987.

The aniline point (AP (° C.)) of the first lubricant base oil depends on the viscosity grade of the lubricant base oil, and it is preferable that the aniline point be not less than a value A represented by the following equation (B), namely, $AP \geq A$:

$$A = 4.3 \times kv100 + 100 \quad (B)$$

wherein kv100 represents the kinematic viscosity at 100° C. of the lubricant base oil ($mm^2/s$).

If AP<A, the viscosity-temperature properties, heat and oxidation stabilities, anti-volatilization, and low temperature viscosity properties tend to be reduced; in the case where an additive is blended with the lubricant base oil, the effect of the additive tends to be reduced.

For example, the AP of the lubricant base oils (I) and (IV) is preferably not less than 108° C., and more preferably not less than 110° C. The AP of the lubricant base oils (II) and (V) is preferably not less than 113° C., and more preferably not less than 119° C. The AP of the lubricant base oils (III) and (VI) is preferably not less than 125° C., and more preferably not less than 128° C. The aniline point of the present invention means the aniline point measured according to JIS K 2256-1985.

The iodine number of the first lubricant base oil is preferably not more than 3, more preferably not more than 2, still more preferably not more than 1, particularly preferably not more than 0.9, and most preferably not more than 0.8. The iodine number may be less than 0.01, but because the effect worth to the iodine number is small and because of cost efficiency, the iodine number is preferably not less than 0.001, more preferably not less than 0.01, still more preferably not less than 0.03, and particularly preferably not less than 0.05. At an iodine number of the lubricant base oil component not more than 3, heat and oxidation stabilities can be significantly improved. The iodine number of the present invention means the iodine number measured according to JIS K 0070 by a method for titrating an indicator, "The acid value, saponification value, iodine number, hydroxyl value, and non-saponification value of chemical products."

The amount of the sulfur content in the first lubricant base oil depends on the sulfur content of the raw material. For example, in the case where a raw material substantially containing no sulfur such as a synthetic wax component obtained by the Fischer-Tropsch reaction or the like is used, the lubricant base oil substantially containing no sulfur can be obtained. In the case where a raw material containing sulfur such as a slack wax obtained by a refining process of the lubricant base oil and a microcrystalline wax obtained by a wax refining process is used, the sulfur content in the lubricant base oil to be obtained is usually not less than 100 mass ppm. In the first lubricant base oil, from the viewpoint of further improvement in heat and oxidation stabilities and reduction of sulfur, the sulfur content is preferably not more than 100 mass ppm, more preferably not more than 50 mass ppm, still more preferably not more than 10 mass ppm, and particularly preferably not more than 5 mass ppm.

The amount of the nitrogen content in the first lubricant base oil is not particularly limited, and is preferably not more than 7 mass ppm, more preferably not more than 5 mass ppm, and still more preferably not more than 3 mass ppm. At a nitrogen content more than 5 mass ppm, the heat and oxidation stabilities tend to be reduced. The nitrogen content of the present invention means the nitrogen content measured according to JIS K 2609-1990.

The % $C_p$ of the first lubricant base oil is preferably not less than 70, preferably 80 to 99, more preferably 85 to 95, still more preferably 86 to 94, and particularly preferably 86 to 90. In the case where the % $C_p$ of the lubricant base oil is less than the lower limit, the viscosity-temperature properties, heat and oxidation stabilities, and friction properties tend to be reduced; further, in the case where an additive is blended with the lubricant base oil, the effect of the additive tends to be reduced. If the % $C_p$ of the lubricant base oil is more than the upper limit, the solubility of the additive tends to be reduced.

The % $C_A$ of the first lubricant base oil is preferably not more than 2, more preferably not more than 1, still more preferably not more than 0.8, and particularly preferably not more than 0.5. If the % $C_A$ of the lubricant base oil is more than the upper limit, the viscosity-temperature properties, heat and oxidation stabilities, and fuel efficiency tend to be reduced.

The % $C_N$ of the first lubricant base oil is preferably not more than 30, more preferably 4 to 25, still more preferably 5 to 20, and particularly preferably 10 to 15. If the % $C_N$ of the lubricant base oil is more than the upper limit, the viscosity-temperature properties, heat and oxidation stabilities, and friction properties tend to be reduced. If the % $C_N$ is less than the lower limit, the solubility of the additive tends to be reduced.

The % $C_P$, % $C_N$, and % $C_A$ in the present invention mean a percentage of the number of carbon atoms in paraffin based on the number of the whole carbon atoms, a percentage of the number of carbon atoms in naphthene based on the number of the whole carbon atoms, and a percentage of the number of carbon atoms in aromatic based on the number of the whole carbon atoms, respectively, determined by a method according to ASTM D 3238-85 (n-d-M ring analysis). Namely, preferable ranges of the % $C_P$, % $C_N$, and % $C_A$ are based on the value determined by the method described above, and for example, even a lubricant base oil containing no naphthene may show a value more than 0 in the % $C_N$ determined by the method described above.

The amount of the saturated content in the first lubricant base oil is not particularly limited, and is preferably not less than 90% by mass, preferably not less than 95% by mass, and more preferably not less than 99% by mass based on the whole amount of the lubricant base oil; the proportion of the cyclic saturated content in the saturated content is preferably not more than 40% by mass, preferably not more than 35% by mass, preferably not more than 30% by mass, more preferably not more than 25% by mass, and still more preferably not more than 21% by mass. The proportion of the cyclic saturated content in the saturated content is preferably not less than 5% by mass, and more preferably not less than 10% by mass. If the proportion of the saturated content and that of the cyclic saturated content in the saturated content each satisfy the conditions described above, the viscosity-temperature properties and the heat and oxidation stabilities can be improved; in the case where an additive is blended with the lubricant base oil, the additive can sufficiently stably be dissolved and kept in the lubricant base oil to demonstrate the function of the additive at a higher level. Further, according to the first embodiment, the friction properties of the lubricant base oil itself can be improved; as a result, improvement in reduction in friction and reduction in energy can be achieved.

The saturated content in the present invention is measured by the method according to ASTM D 2007-93.

In a method for separating the saturated content or composition analysis of the cyclic saturated content, acyclic saturated content, and the like, a similar method by which the same result can be obtained can be used. For example, other than above, examples thereof can include the method according to ASTM D 2425-93, the method according to ASTM D 2549-91, a method by high performance liquid chromatography (HPLC), or a modified method of these.

The aromatic content of the first lubricant base oil is not particularly limited; the aromatic content is preferably not more than 5% by mass, more preferably not more than 4% by mass, still more preferably not more than 3% by mass, and particularly preferably not more than 2% by mass, and preferably not less than 0.1% by mass, more preferably not less than 0.5% by mass, still more preferably not less than 1% by mass, and particularly preferably not less than 1.5% by mass based on the whole amount of the lubricant base oil. At an amount of the aromatic content more than the upper limit, the viscosity-temperature properties, heat and oxidation stabilities, friction properties, anti-volatilization properties, and low temperature viscosity properties tend to be reduced; further, in the case where an additive is blended with the lubricant base oil, the effect of the additive tends to be reduced. While the first lubricant base oil may be those containing no aromatic content, at an amount of the aromatic content not less than the lower limit, the solubility of the additive can be further enhanced.

The aromatic content in the present invention means a value measured according to ASTM D 2007-93. The aromatic content usually includes alkylbenzenes; alkylnaphthalenes; anthracenes, phenanthrenes, and alkylated products of these; compounds in which four or more benzene rings are condensed; and aromatic compounds having a heteroatom such as pyridines, quinolines, phenols, and naphthols.

In the first lubricant oil composition, the first lubricant base oil may be used alone, or the first lubricant base oil may be used in combination with other one or two or more base oils. In the case where the first lubricant base oil is used in combination with other base oil, the proportion of the lubricant base oil according to the present invention in the mixed base oils is preferably not less than 30% by mass, more preferably not less than 50% by mass, and still more preferably not less than 70% by mass.

The other base oil used in combination with the first lubricant base oil is not particularly limited, and examples of mineral base oils include solvent refined mineral oils, hydrocracked mineral oils, hydrorefined mineral oils, solvent dewaxed base oils in which the kinematic viscosity at 100° C. is 1 to 100 $mm^2/s$, and the % $C_p$ and % $C_A$ do not satisfy the conditions described above.

Examples of synthetic base oils include poly-α-olefins or hydrogenated products thereof, isobutene oligomers or hydrogenated products thereof, isoparaffin, alkylbenzenes, alkylnaphthalenes, diesters (such as ditridecylglutarate, di-2-ethylhexyladipate, diisodecyladipate, ditridecyladipate, and di-2-ethylhexylsebacate), polyol esters (such as trimethylolpropanecaprylate, trimethylolpropanepelargonate, pentaerythritol-2-ethylhexanoate, and pentaerythritolpelargonate), polyoxyalkylene glycol, dialkyldiphenyl ethers, polyphenyl ethers in which the kinematic viscosity at 100° C. does not satisfy the condition described above; among them, poly-α-olefins are preferable. Examples of poly-α-olefins include oligomers or co-oligomers of α-olefins with typically 2 to 32 carbon atoms, and preferably 6 to 16 carbon atoms (such as 1-octene oligomers, decene oligomers, and ethylene-propylene co-oligomer) and hydrogenated products thereof.

A method for producing poly-α-olefin is not particularly limited, and examples thereof include a method for polymerizing α-olefin in the presence of a polymerization catalyst such as a Friedel-Crafts catalyst containing a complex of aluminium trichloride or boron trifluoride with water, an alcohol (such as ethanol, propanol, and butanol), and a carboxylic acid or ester.

The viscosity index improver used in the first embodiment is a viscosity index improver in which a ratio M1a/M2a of a total area M1a of peaks in a chemical shift between 29-31 ppm to a total area M2a of peaks in a chemical shift between 64-69 ppm based on a total area of all the peaks is not less than 10 in a spectrum obtained by nuclear magnetic resonance ($^{13}$C-NMR) (hereinafter, referred to as a "first viscosity index improver").

The M1a/M2a is preferably not less than 12, more preferably not less than 14, particularly preferably not less than 16, and most preferably not less than 18. The M1/M2 is preferably not more than 40, more preferably not more than 35, particularly preferably not more than 30, and most preferably not more than 25. At an M1/M2 less than 10, necessary fuel efficiency cannot be obtained, and the low temperature viscosity properties may be reduced. At an M1/M2 more than 40, necessary fuel efficiency may not be obtained, and solubility and storing stability may be reduced.

The spectrum of the nuclear magnetic resonance ($^{13}$C-NMR) is obtained for a polymer from which a diluted oil is separated by rubber film dialysis or the like in the case where the diluted oil is contained in the viscosity index improver.

The total area (M1a) of peaks in a chemical shift between 29-31 ppm based on a total area of all the peaks means the proportion of the integrated intensity derived from a specific ϵ-methylene structure of a polymethacrylate side chain based on a total integrated intensity of all the carbons measured by $^{13}$C-NMR; the total area (M2a) of peaks in a chemical shift between 64-69 ppm based on a total area of all the peaks means the proportion of the integrated intensity of specific α-methylene of a polymethacrylate side chain based on a total integrated intensity of all the carbons measured by $^{13}$C-NMR.

The M1a/M2a means the proportion of the specific ϵ-methylene structure to the specific α-methylene in the polymethacrylate side chain, but other method may be used if the same result can be obtained. In measurement by $^{13}$C-NMR, as a sample, a diluted one obtained by adding 3 g of chloroform-d to 0.5 g of a sample was used, the measurement temperature was room temperature, the resonance frequency was 125 MHz, and a gated decoupling method was used as the measurement method.

By the analysis above, (a) the total integrated intensity in the chemical shift between approximately 10-70 ppm (the total integrated intensity derived from all the carbons in hydrocarbons), and (b) the total integrated intensity in the chemical shift between 29-31 ppm (the total integrated intensity derived from the specific s-methylene structure), and (c) the total integrated intensity in the chemical shift between 64-69 ppm (the total integrated intensity derived from the specific α-methylene)

each are measured; the proportion of (b) (%) was calculated wherein (a) was 100%, and defined as the M1a. Moreover, the proportion of (c) (%) was calculated wherein (a) was 100%, and defined as the M2a.

It is preferable that the first viscosity index improver be poly(meth)acrylate, and be a polymer in which the proportion of the structure unit represented by the following formula (1) is 0.5 to 70 mol %. The first viscosity index improver may be a non-dispersion type or a dispersion type.

[Chemical Formula 1]

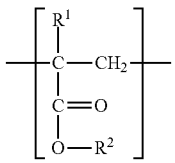

(1)

wherein $R^1$ represents hydrogen or a methyl group, and $R^2$ represents a linear or branched hydrocarbon group with 16 or more carbon atoms or a linear or branched organic group with 16 or more carbon atoms containing oxygen and/or nitrogen.

$R^2$ in the formula (1) is preferably a linear or branched hydrocarbon group with 16 or more carbon atoms, more preferably a linear or branched hydrocarbon with 18 or more carbon atoms, still more preferably a linear or branched hydrocarbon with 20 or more carbon atoms, and particularly preferably a branched hydrocarbon group with 20 or more carbon atoms. The upper limit of the hydrocarbon group represented by $R^2$ is not particularly limited, and a linear or branched hydrocarbon group with 100 or less carbon atoms is preferable. The hydrocarbon group represented by $R^2$ is more preferably a linear or branched hydrocarbon with 50 or less carbon atoms, still more preferably a linear or branched hydrocarbon with 30 or less carbon atoms, particularly preferably a branched hydrocarbon with 30 or less carbon atoms, and most preferably a branched hydrocarbon with 25 or less carbon atoms.

In the first viscosity index improver, the proportion of the (meth)acrylate structure unit represented by the formula (1) in the polymer is, as described above, preferably 0.5 to 70 mol %, preferably not more than 60 mol %, more preferably not more than 50 mol %, still more preferably not more than 40 mol %, and particularly preferably not more than 30 mol %. The proportion is preferably not less than 1 mol %, more preferably not less than 3 mol %, still more preferably not less than 5 mol %, and particularly preferably not less than 10 mol %. At a proportion more than 70 mol %, the effect of improving the viscosity temperature properties and the low temperature viscosity properties may be poor; at a proportion less than 0.5 mol %, the effect of improving the viscosity temperature properties may be poor.

Other than the (meth)acrylate structure unit represented by the formula (1), the first viscosity index improver can contain any (meth)acrylate structure unit or a structure unit derived from any olefin or the like.

Any method for producing the first viscosity index improver can be used; for example, the first viscosity index improver can be easily obtained by radical solution polymerization of a predetermined monomer in the presence of a polymerization initiator such as benzoyl peroxide.

The PSSI (permanent shear stability index) of the first viscosity index improver is preferably not more than 50, more preferably not more than 40, still more preferably not more than 35, and particularly preferably not more than 30. The PSSI is preferably not less than 5, more preferably not less than 10, still more preferably not less than 15, and particularly preferably not less than 20. At a PSSI less than 5, the effect of improving the viscosity index is small and cost may be increased; at a PSSI more than 50, shear stability and storing stability may be reduced.

The weight-average molecular weight ($M_W$) of the first viscosity index improver is preferably not less than 100,000, more preferably not less than 200,000, still more preferably not less than 250,000, and particularly preferably not less than 300,000. The weight-average molecular weight is preferably not more than 1,000,000, more preferably not more than 700,000, still more preferably not more than 600,000, and particularly preferably not more than 500,000. At a weight-average molecular weight less than 100,000, the effect of improving the viscosity temperature properties and the effect of improving the viscosity index are small, and cost may be increased; at a weight-average molecular weight more than 1,000,000, the shear stability, the solubility in the base oil, and the storing stability may be reduced.

The number-average molecular weight ($M_N$) of the first viscosity index improver is preferably not less than 50,000, more preferably not less than 800,000, still more preferably not less than 100,000, and particularly preferably not less than 120,000. The number-average molecular weight is preferably not more than 500,000, more preferably not more than 300,000, still more preferably not more than 250,000, and particularly preferably not more than 200,000. At a number-average molecular weight less than 50,000, the effect of improving the viscosity temperature properties and the effect of improving the viscosity index are small, and cost may be increased; at a number-average molecular weight more than 500,000, the shear stability, the solubility in the base oil, and the storing stability may be reduced.

The ratio ($M_W$/PSSI) of the weight-average molecular weight to the PSSI of the first viscosity index improver is preferably not less than $0.8\times10^4$, more preferably not less than $1.0\times10^4$, still more preferably not less than $1.5\times10^4$, preferably not less than $1.8\times10^4$, and particularly preferably not less than $2.0\times10^4$. At an $M_W$/PSSI less than $0.8\times10^4$, the viscosity temperature properties may be reduced, namely, the fuel efficiency may be reduced.

The ratio ($M_W/M_N$) of the weight-average molecular weight to the number-average molecular weight of the first viscosity index improver is preferably not less than 0.5, preferably not less than 1.0, more preferably not less than 1.5, still more preferably not less than 2.0, and particularly preferably not less than 2.1. The $M_W/M_N$ is preferably not more than 6.0, more preferably not more than 4.0, still more preferably not more than 3.5, and particularly preferably not more than 3.0. At an $M_W/M_N$ less than 0.5 or more than 6.0, the viscosity temperature properties may be reduced, namely, the fuel efficiency may be reduced.

The viscosity-increasing ratio ΔKV40/ΔKV100 of the kinematic viscosity at 40° C. to the kinematic viscosity at 100° C. of the first viscosity index improver is preferably not more than 4.0, more preferably not more than 3.5, still more preferably not more than 3.0, particularly preferably not more than 2.5, and most preferably not more than 2.3. The ΔKV40/ΔKV100 is preferably not less than 0.5, more preferably not less than 1.0, still more preferably not less than 1.5, and particularly preferably not less than 2.0. At a ΔKV40/ΔKV100 less than 0.5, the effect of increasing the viscosity and the solubility are small, and cost may be increased; at a ΔKV40/ΔKV100 more than 4.0, the effect of improving the viscosity temperature properties and the low temperature viscosity properties may be poor. The ΔKV40 means an amount of the kinematic viscosity at 40° C. to be increased when 3.0% of the viscosity index improver is added to YUBASE 4 made by SK Lubricants Co., Ltd., and the ΔKV100 means the amount of the kinematic viscosity at 100° C. to be increased when 3.0% of the viscosity index improver is added to YUBASE 4 made by SK Lubricants Co., Ltd.

The viscosity-increasing ratio ΔHTHS100/ΔHTHS150 of the HTHS viscosity at 100° C. to the HTHS viscosity at 150° C. of the first viscosity index improver is preferably not more than 2.0, more preferably not more than 1.7, still more preferably not more than 1.6, and particularly preferably not more than 1.55. The ΔHTHS100/ΔHTHS150 is preferably not less than 0.5, more preferably not less than 1.0, still more preferably not less than 1.2, and particularly preferably not less than 1.4. At a ΔHTHS100/ΔHTHS150 less than 0.5, the effect of improving the viscosity and the solubility are small, and cost may be increased; at a ΔHTHS100/ΔHTHS150 more than 2.0, the effect of improving the viscosity temperature properties and the low temperature viscosity properties may be poor.

The ΔHTHS100 means the amount of the HTHS viscosity at 100° C. to be increased when 3.0% of the viscosity index improver is added to YUBASE 4 made by SK Lubricants Co., Ltd., and the ΔHTHS150 means the amount of the HTHS viscosity at 150° C. to be increased when 3.0% of the viscosity index improver is added to YUBASE 4 made by SK Lubricants Co., Ltd. The ΔHTHS100/ΔHTHS150 means the ratio of the amount of the HTHS viscosity at 100° C. to be increased to the amount of the HTHS viscosity at 150° C. to be increased. The HTHS viscosity at 100° C. here designates the high temperature high shear viscosity at 100° C. specified by ASTM D 4683. The HTHS viscosity at 150° C. designates the high temperature high shear viscosity at 150° C. specified by ASTM D 4683.

The content of the first viscosity index improver in the first lubricant oil composition is preferably 0.01 to 50% by mass, more preferably 0.5 to 40% by mass, still more preferably 1 to 30% by mass, and particularly preferably 5 to 20% by mass based on the whole amount of the composition. At a content of the viscosity index improver less than 0.1% by mass, the effect of improving the viscosity index and the effect of reducing the viscosity of the product are small, and therefore, improvement in the fuel efficiency may not be achieved. At a content of the viscosity index improver more than 50% by mass, cost of the product is largely increased and the viscosity of the base oil needs to be reduced; accordingly, the lubricant performance under a severe lubricant condition (high temperature high shear condition) may be reduced, causing malfunctions such as wear, seizure, and fatigue breaking.

In order to enhance the fuel efficiency performance, it is preferable that a compound selected from organic molybdenum compounds and ash-free friction modifiers be further contained in the first lubricant oil composition.

Examples of the organic molybdenum compound used in the first embodiment can include organic molybdenum compounds containing sulfur such as molybdenum dithiophosphate and molybdenum dithiocarbamate; complexes of molybdenum compounds (for example, molybdenum oxides such as molybdenum dioxide, and molybdenum trioxide, molybdic acids such as ortho-molybdic acid, para-molybdic acid, and (poly)molybdic sulfide acid, molybdic acid salts such as metal salts and ammonium salts of these molybdic acids, molybdenum sulfides such as molybdenum disulfide, molybdenum trisulfide, molybdenum pentasulfide, and polymolybdenum sulfide, molybdic sulfide acid, metal salts or amine salts of molybdic sulfide acid, and molybdenum halides such as molybdenum chloride) with sulfur-containing organic compounds (for example, alkyl(thio)xanthate, thiadiazole, mercapto thiadiazole, thiocarbonate, tetrahydrocarbylthiuram disulfide, bis(di(thio)hydrocarbyl dithiophosphonate)disulfide, organic (poly)sulfide, and sulfurized esters) or other organic compound; or complexes of the sulfur-containing molybdenum compounds such as molybdenum sulfide and molybdic sulfide acid with alkenyl succinimides.

As the organic molybdenum compound, an organic molybdenum compound containing no sulfur as a component element can be used. Examples of the organic molybdenum compound containing no sulfur as a component element specifically include molybdenum-amine complexes, molybdenum-succinimide complexes, molybdenum salts of organic acids, and molybdenum salts of alcohols; among these, molybdenum-amine complexes, molybdenum salts of organic acids, and molybdenum salts of alcohols are preferable.

In the first lubricant oil composition, in the case where the organic molybdenum compound is used, the content is not particularly limited, and is preferably not less than 0.001% by mass, more preferably not less than 0.005% by mass, still more preferably not less than 0.01% by mass, and particularly preferably not less than 0.03% by mass, and preferably not more than 0.2% by mass, more preferably not more than 0.1% by mass, still more preferably not more than 0.08% by mass, and particularly preferably not more than 0.06% by mass based on the whole amount of the composition in terms of the molybdenum element. At a content less than 0.001% by mass, the heat and oxidation stabilities of the lubricant oil composition are insufficient, and particularly, high detergency tends not to be kept for a long period of time. On the other hand, at a content more than 0.2% by mass, the effect proportional to the content cannot be obtained, and the storing stability of the lubricant oil composition tends to be reduced.

As the ash-free friction modifier, any compound usually used as the friction modifier for the lubricant oil can be used, and examples thereof include compounds with 6 to 50 carbon atoms containing one or two or more hetero elements selected from an oxygen atom, a nitrogen atom, and a sulfur atom in the molecule. More specifically, examples thereof include ash-free friction modifiers such as amine compounds, fatty acid esters, fatty acid amides, fatty acids, aliphatic alcohols, aliphatic ethers, urea compounds, and hydrazide compounds having at least one of an alkyl group or alkenyl group with 6 to 30 carbon atoms, particularly a linear alkyl group, linear alkenyl group, branched alkyl group, and branched alkenyl group with 6 to 30 carbon atoms in the molecule.

The content of the ash-free friction modifier in the first lubricant oil composition is preferably not less than 0.01% by mass, more preferably not less than 0.1% by mass, and still more preferably not less than 0.3% by mass, and preferably not more than 3% by mass, more preferably not more than 2% by mass, and still more preferably not more than 1% by mass based on the whole amount of the composition. At a content of the ash-free friction modifier less than 0.01% by mass, the effect of reducing friction by addition of the ash-free friction modifier tends to be insufficient; at a content of the ash-free friction modifier more than 3% by mass, the effect of an anti-wear additive or the like tends to be inhibited, or the solubility of the additive tends to be reduced. As the friction modifier, use of the ash-free friction modifier is more preferable.

In order to further improve the performance, any additives usually used for the lubricant oil according to the purpose can be contained in the first lubricant oil composition. Examples of such an additive can include additives such as a metallic detergent, an ash-free dispersant, an antioxidant, a wear-resistant agent (or extreme-pressure agent), a corrosion inhibitor, a rust inhibitor, an antiemulsifier, a metal deactivator, and an antifoaming agent.

Examples of the metallic detergent include normal salts, basic normal salts or overbased salts of alkali metal sulfonates or alkaline earth metal sulfonates, alkali metal phenates or alkaline earth metal phenates, and alkali metal salicylates or alkaline earth metal salicylates. In the present invention, one or two or more alkali metal or alkaline earth metallic detergents selected from the group consisting of these, particularly alkaline earth metallic detergents can be preferably used. Particularly, magnesium salts and/or calcium salts are preferably used, and calcium salts are more preferably used.

As the ash-free dispersant, any ash-free dispersant used for the lubricant oil can be used; examples thereof include mono- or bis-succinimide having at least one linear or branched alkyl group or alkenyl group with 40 to 400 carbon atoms in the molecule, benzylamines having at least one alkyl group or alkenyl group with 40 to 400 carbon atoms in the molecule, polyamines having at least one alkyl group or alkenyl group with 40 to 400 carbon atoms in the molecule, boron compounds of these, and modified products with carboxylic acid, phosphoric acid or the like. In use, one or two or more arbitrarily selected from these can be blended.

Examples of the antioxidant include ash-free antioxidants such as phenol antioxidants and amine antioxidants and metallic antioxidants such as copper antioxidants and molybdenum antioxidants. Specifically, examples of the phenol ash-free antioxidants include 4,4'-methylene-bis-(2,6-di-tert-butylphenol) and 4,4'-bis-(2,6-di-tert-butylphenol), and examples of the amine ash-free antioxidants include phenyl-α-naphthylamine, alkylphenyl-α-naphthylamine, and dialkyldiphenylamine.

As the wear-resistant agent (or extreme-pressure agent), any wear-resistant agents and extreme-pressure agents used for the lubricant oil can be used. For example, sulfur extreme-pressure agents, phosphorus extreme-pressure agents, and sulfur-phosphorus extreme-pressure agents can be used; specifically, examples thereof include phosphorous acid esters, thiophosphorous acid esters, dithiophosphorous acid esters, trithiophosphorous acid esters, phosphoric acid esters, thiophosphoric acid esters, dithiophosphoric acid esters, trithiophosphoric acid esters, amine salts thereof, metal salts thereof, derivatives thereof, dithiocarbamates, zinc dithiocarbamate, molybdenum dithiocarbamate, disulfides, polysulfides, olefin sulfides, and sulfurized fats and oils. Among these, addition of a sulfur extreme-pressure agent is preferable, and particularly sulfurized fats and oils are preferable.

Examples of the corrosion inhibitor include benzotriazole compounds, tolyltriazole compounds, thiadiazole compounds, or imidazole compounds.

Examples of the rust inhibitor include petroleum sulfonates, alkylbenzene sulfonates, dinonylnaphthalene sulfonates, alkenyl succinic acid esters, or polyhydric alcohol esters.

Examples of the antiemulsifier include polyalkylene glycol nonionic surface active agents such as polyoxyethylene alkyl ether, polyoxyethylene alkyl phenyl ether, or polyoxyethylene alkyl naphthyl ether.

Examples of the metal deactivator include imidazolines, pyrimidine derivatives, alkylthiadiazoles, mercaptobenzothiazoles, benzotriazole or derivatives thereof, 1,3,4-thiadiazolepolysulfide, 1,3,4-thiadiazolyl-2,5-bis-dialkyldithiocarbamate, 2-(alkyldithio)benzimidazole, or β-(o-carboxybenzylthio)propionitrile.

Examples of the antifoaming agent include silicone oils, alkenyl succinic acid derivatives, esters of polyhydroxyaliphatic alcohols and long-chain fatty acids, methyl salicylate, and o-hydroxybenzyl alcohols whose kinematic viscosity at 25° C. is 1000 to 100,000 $mm^2/s$.

In the case where these additives are contained in the first lubricant oil composition, each content is 0.01 to 10% by mass based on the whole amount of the composition.

The kinematic viscosity at 100° C. of the first lubricant oil composition is preferably 4 to 20 $mm^2/s$, the upper limit is more preferably not more than 15 $mm^2/s$, still more preferably not more than 13 $mm^2/s$, particularly preferably not more than 12 $mm^2/s$, most preferably not more than 11 $mm^2/s$, and further most preferably not more than 10 $mm^2/s$. The lower limit of the kinematic viscosity at 100° C. of the first lubricant oil composition is preferably not less than 4 $mm^2/s$, more preferably not less than 6 $mm^2/s$, still more preferably not less than 8 $mm^2/s$, and particularly preferably not less than 9 $mm^2/s$. The kinematic viscosity at 100° C. here designates the kinematic viscosity at 100° C. specified by ASTM D-445. At a kinematic viscosity at 100° C. less than 4 $mm^2/s$, insufficient lubricating properties may be caused; at a kinematic viscosity at 100° C. more than 20 $mm^2/s$, a necessary low temperature viscosity and sufficient fuel efficiency performance may not be obtained.

The kinematic viscosity at 40° C. of the first lubricant oil composition is preferably 5 to 80 $mm^2/s$; the upper limit is more preferably not more than 70 $mm^2/s$, particularly preferably not more than 60 $mm^2/s$, most preferably not more than 55 $mm^2/s$, and further most preferably not more than 50 $mm^2/s$. The lower limit of the kinematic viscosity at 40° C. of the first lubricant oil composition is more preferably not less than 10 $mm^2/s$, still more preferably not less than 20 $mm^2/s$, particularly preferably not less than 30 $mm^2/s$, and most preferably not less than 35 $mm^2/s$. The kinematic viscosity at 40° C. here designates the kinematic viscosity at 40° C. specified by ASTM D-445. At a kinematic viscosity at 40° C. less than 5 $mm^2/s$, insufficient lubricating properties may be caused; at a kinematic viscosity at 40° C. more than 80 $mm^2/s$, a necessary low temperature viscosity and sufficient fuel efficiency performance may not be obtained.

The viscosity index of the first lubricant oil composition is preferably in the range of 140 to 400, preferably not less than 200, more preferably not less than 220, still more preferably not less than 240, and particularly preferably not less than 260. At a viscosity index of the first lubricant oil composition less than 140, it may be difficult to improve the fuel efficiency while the HTHS viscosity at 150° C. is kept, and further, it may be difficult to reduce the low temperature viscosity at −35° C. At a viscosity index of the first lubricant oil composition not less than 400, evaporation properties may be reduced, and further, malfunctions caused by insufficient solubility of the additive and adaptability to a sealing material may be caused.

The HTHS viscosity at 100° C. of the first lubricant oil composition is preferably not more than 10 mPa·s, more preferably not more than 8.0 mPa·s, still more preferably not more than 7.0 mPa·s, and particularly preferably not more than 6.5 mPa·s. The HTHS viscosity at 100° C. of the first lubricant oil composition is preferably not less than 3.0 mPa·s, still more preferably not less than 4.0 mPa·s, particularly preferably not less than 5.0 mPa·s, and most preferably not less than 6.0 mPa·s. The HTHS viscosity at 100° C. here designates the high temperature high shear viscosity at 100° C. specified by ASTM D4683. At an HTHS viscosity at 100° C. less than 3.0 mPa·s, insufficient lubricating properties may be caused; at an HTHS viscosity at 100° C. more than 10 mPa·s, a necessary low temperature viscosity and sufficient fuel efficiency performance may not be obtained.

The HTHS viscosity at 150° C. of the first lubricant oil composition is preferably not more than 5.0 mPa·s, more preferably not more than 4.5 mPa·s, still more preferably not more than 4.0 mPa·s, and particularly preferably not more than 3.7 mPa·s. The HTHS viscosity at 150° C. of the first lubricant oil composition is preferably not less than 2.0 mPa·s, more preferably not less than 2.5 mPa·s, still more preferably not less than 3.0 mPa·s, particularly preferably not less than 3.4 mPa·s, and most preferably not less than 3.5 mPa·s. The HTHS viscosity at 150° C. here designates the high temperature high shear viscosity at 150° C. specified by ASTM D4683. At an HTHS viscosity at 150° C. less than 2.0 mPa·s, insufficient lubricating properties may be caused; at an HTHS viscosity at 150° C. more than 5.0 mPa·s, a necessary low temperature viscosity and sufficient fuel efficiency performance may not be obtained.

The ratio (HTHS viscosity at 150° C./HTHS viscosity at 100° C.) of the HTHS viscosity at 150° C. to the HTHS viscosity at 100° C. of the first lubricant oil composition is preferably not less than 0.50, more preferably not less than 0.52, still more preferably not less than 0.53, particularly preferably not less than 0.54, and most preferably not less than 0.55. At a ratio less than 0.50, a necessary low temperature viscosity and sufficient fuel efficiency performance may not be obtained.

The first lubricant oil composition is the one whose fuel efficiency and lubricating properties are high, and in which without using a synthetic oil such as a poly-α-olefin base oil and an ester base oil or a low viscosity mineral base oil, the kinematic viscosities at 40° C. and 100° C. and HTHS viscosity at 100° C. of the lubricant oil are remarkably reduced, which is effective in improvement in fuel efficiency, while the HTHS viscosity at 150° C. is kept at a constant level. The first lubricant oil composition having such high properties can be suitably used as fuel-efficient engine oils such as fuel-efficient gasoline engine oils and fuel-efficient diesel engine oils.

[Second Embodiment]

A lubricant oil composition according to a second embodiment of the present invention is a lubricant oil composition (second lubricant oil composition) comprising: a lubricant base oil whose kinematic viscosity at 100° C. is 1 to 5 $mm^2/s$; and a viscosity index improver in which a ratio M1/M2b of a total area M1of peaks in a chemical shift between 51-52.5 ppm to a total area M2b of peaks in a chemical shift between 64-66 ppm based on a total area of all the peaks is not less than 0.50 in a spectrum obtained by $^{13}C$-NMR, wherein a ratio of an HTHS viscosity at 150° C. to an HTHS viscosity at 100° C. satisfies a condition represented by the following equation (A):

$$\text{HTHS (150° C.)}/\text{HTHS (100° C.)} \geq 0.50 \quad \text{(A)}$$

wherein HTHS (100° C.) represents the HTHS viscosity at 100° C., and HTHS (150° C.) represents the HTHS viscosity at 150° C.

The second lubricant base oil is not particularly limited as long as the kinematic viscosity at 100° C. satisfies the condition described above. Examples of the second lubricant base oil include the lubricant base oils whose kinematic viscosity at 100° C. is 1 to 5 $mm^2/s$ among those exemplified as the first lubricant base oil in the first embodiment, but duplicated description thereof will be omitted here.

The kinematic viscosity at 100° C. of the second lubricant base oil is not more than 5 $mm^2/s$, preferably not more than 4.9 $mm^2/s$, more preferably not more than 4.8 $mm^2/s$, still more preferably not more than 4.7 $mm^2/s$, particularly preferably not more than 4.6 $mm^2/s$, and most preferably not more than 4.5 $mm^2/s$. On the other hand, the kinematic viscosity at 100° C. needs to be not less than 1 $mm^2/s$, and is preferably not less than 1.5 $mm^2/s$, more preferably not less than 2 $mm^2/s$, still more preferably not less than 2.5 $mm^2/s$, and particularly preferably not less than 3 $mm^2/s$. The kinematic viscosity at 100° C. here designates the kinematic viscosity at 100° C. specified by ASTM D-445. In the case where the kinematic viscosity at 100° C. of the lubricant base oil component is more than 20 $mm^2/s$, the low temperature viscosity properties may be reduced, and sufficient fuel efficiency may not be obtained; at a kinematic viscosity at 100° C. less than 1 $mm^2/s$, the lubricating properties may be poor because oil film formation in a lubricated place is insufficient, and evaporation loss of the lubricant oil composition may be increased.

The urea adduct value in the second lubricant base oil is preferably not more than 5% by mass, more preferably not more than 3% by mass, still more preferably not more than 2.5% by mass, and particularly preferably not more than 2% by mass from the viewpoint of improving the low temperature viscosity properties and obtaining high heat conductivity without impairing the viscosity-temperature properties. The urea adduct value may be 0% by mass, but is preferably not less than 0.1% by mass, more preferably not less than 0.5% by mass, and particularly preferably not less than 0.8% by mass because a lubricant base oil with sufficient low temperature viscosity properties and a higher viscosity index can be obtained, the dewaxing condition is relaxed, and cost efficiency is high.

Here, the urea adduct value means the value measured by the following method.

100 g of a weighed sample oil is placed into a round-bottomed flask; 200 mg of urea, 360 ml of toluene, and 40 ml of methanol are added, and stirred at room temperature for 6 hours. Thereby, white granular crystals are produced in the reaction solution as a urea adduct. The reaction solution is filtered by a 1-micron filter to collect the produced white granular crystals, and the obtained crystals are washed by 50 ml of toluene six times. The recovered white crystals are placed into a flask; 300 ml of pure water and 300 ml of toluene are added, and stirred at 80° C. for 1 hour. An aqueous phase is separated by a separating funnel and removed, and a toluene phase is washed by 300 ml of pure water three times. A desiccant (sodium sulfate) is added to the toluene phase; a dehydration treatment is performed, and toluene is distilled. The proportion (mass percentage) of the thus-obtained urea adduct to the sample oil is defined as the urea adduct value.

In the measurement of the urea adduct value, a component in isoparaffin that adversely affects the low temperature viscosity properties, a component that reduces the heat conductivity, and normal paraffin when the normal paraffin remains in the lubricant base oil can be captured as the urea adduct accurately and securely; accordingly, the urea adduct value is advantageous as an evaluation index of the low temperature viscosity properties and heat conductivity of the lubricant base oil. By the analysis using GC and NMR, the present inventors recognize that the principal component of the urea adduct is a urea adduct of normal paraffin and isoparaffin with 6 or more carbon atoms from the terminal of the main chain to the branched position.

In the second lubricant oil composition, the second lubricant base oil may be used alone, or the second lubricant base oil may be used in combination with other one or two or more base oils. In the case where the second lubricant base oil is used in combination with other base oil, the proportion of the lubricant base oil according to the present invention in these mixed base oils is preferably not less than 30% by mass, more preferably not less than 50% by mass, and still more preferably not less than 70% by mass.

The other base oil used in combination with the second lubricant base oil is not particularly limited; examples thereof include mineral base oils such as solvent refined mineral oils, hydrocracked mineral oils, hydrorefined mineral oils, and solvent dewaxed base oils in which the kinematic viscosity at 100° C. is 5 to 500 $mm^2/s$ and % $C_p$ and % $C_A$ do not satisfy the conditions described above, or synthetic base oils. By blending the other base oil with the lubricant base oil according to the present invention, the high temperature detergency of the lubricant oil composition is improved.

In the case where the mineral base oil is used as the other base oil in the second lubricant oil composition, the kinematic viscosity at 100° C. is preferably 5 to 500 $mm^2/s$, preferably not less than 5.3 $mm^2/s$, more preferably not less than 5.5 $mm^2/s$, still more preferably not less than 5.7 $mm^2/s$, and most preferably not less than 5.9 $mm^2/s$. The upper limit is more preferably not more than 100 $mm^2/s$, still more preferably not more than 50 $mm^2/s$, particularly preferably not more than 30 $mm^2/s$, most preferably not more than 20 $mm^2/s$, and further most preferably not more than 10 $mm^2/s$. In the case where the kinematic viscosity at 100° C. of the other base oil is less than 5 $mm^2/s$, the high temperature detergency may be reduced; in the case where the kinematic viscosity at 100° C. is more than 500 $mm^2/s$, the viscosity temperature properties are reduced, necessary fuel efficiency cannot be obtained, and the low temperature viscosity properties may be reduced.

The viscosity index of the other base oil is not particularly limited, and is preferably not less than 80, more preferably not less than 100, still more preferably not less than 120, particularly preferably not less than 130, and most preferably not less than 135. The viscosity index is preferably not more than 180, more preferably not more than 170, still more preferably not more than 160, and particularly preferably not more than 150. At a viscosity index less than the lower limit, the fuel efficiency and low temperature viscosity properties are reduced, and the heat and oxidation stabilities and anti-volatilization tend to be reduced. At a viscosity index more than the upper limit, the low temperature viscosity properties tend to be largely reduced.

The NOACK evaporation amount of the other base oil is not particularly limited, and is preferably not more than 20% by mass, more preferably not more than 15% by mass, still more preferably not more than 10% by mass, particularly preferably not more than 8% by mass, and most preferably not more than 7% by mass. At an NOACK evaporation amount not more than the upper limit, low volatility can be obtained, and the detergency can be improved. The NOACK evaporation amount is preferably not less than 1% by mass, more preferably not less than 3% by mass, and still more preferably not less than 5% by mass. At an NOACK evaporation amount not more than the lower limit, necessary fuel efficiency cannot be obtained, and the low temperature viscosity properties may be reduced.

Examples of the synthetic base oil include the synthetic base oils exemplified in the description of the first embodiment.

The second viscosity index improver is a viscosity index improver in which a ratio M1b/M2b of a total area M1b of peaks in a chemical shift between 51-52.5 ppm to a total area M2b of peaks in a chemical shift between 64-66 ppm based on a total area of all the peaks is not less than 0.50 in a spectrum obtained by a nuclear magnetic resonance ($^{13}$C-NMR).

The M1b/M2b is preferably not less than 1.0, more preferably not less than 2.0, particularly preferably not less than 3.0, and most preferably not less than 4.0. The M1b/M2b is preferably not more than 10, more preferably not more than 9.0, particularly preferably not more than 8.0, and most preferably not more than 7.0. At an M1/M2b less than 0.50, necessary fuel efficiency cannot be obtained, and the low temperature viscosity properties may be reduced. At an M1/M2b more than 10, necessary fuel efficiency cannot be obtained, and the solubility and the storing stability may be reduced.

The spectrum of the nuclear magnetic resonance ($^{13}$C-NMR) is obtained for a polymer from which a diluted oil is separated by rubber film dialysis or the like in the case where the diluted oil is contained in the viscosity index improver.

The total area M1b of peaks in a chemical shift between 51-52.5 ppm based on a total area of all the peaks means the proportion of the integrated intensity derived from a specific methyl structure of the polymethacrylate side chain based on a total integrated intensity of all the carbons measured by $^{13}$C-NMR; the total area M2b of peaks in a chemical shift between 64-66 ppm based on a total area of all the peaks means the proportion of the integrated intensity derived from a specific linear structure of the polymethacrylate side chain based on a total integrated intensity of all the carbons measured by $^{13}$C-NMR.

The M1b/M2b means the proportion of the specific methyl structure to the specific linear structure in the polymethacrylate side chain, but any other method may be used if the same result can be obtained. In measurement by $^{13}$C-NMR, as a sample, a diluted one obtained by adding 3 g of chloroform-d to 0.5 g of a sample was used, the measurement temperature was room temperature, the resonance frequency was 125 MHz, and a gated decoupling method was used as the measurement method.

By the analysis above, (a) the total integrated intensity of the chemical shift between approximately 10-70 ppm (the total integrated intensity derived from all the carbons in hydrocarbons), and (b) the total integrated intensity of the chemical shift between 51-52.5 ppm (the total integrated intensity derived from the specific methyl structure), and (c) the total integrated intensity of the chemical shift between 64-66 ppm (the total integrated intensity derived from the specific linear structure)

each are measured; the proportion of (b) (%) was calculated wherein (a) was 100%, and defined as the M1b. Moreover, the proportion of (c) (%) was calculated wherein (a) was 100%, and defined as the M2b.

It is preferable that the second viscosity index improver be poly(meth)acrylate, and is a polymer in which the proportion of the structure unit represented by the formula (1), which is shown in the description of the first viscosity index improver according to the first embodiment, is 0.5 to 70 mol %. The viscosity index improver may be a non-dispersion type or a dispersion type.

A preferable aspect concerning $R^2$ in the formula (1), the proportion of the (meth)acrylate structure unit represented by the formula (1) in the polymer or the like is the same as that in the case of the first viscosity index improver according to the first embodiment. Further, other than the (meth)acrylate structure unit represented by the formula (1), the second viscosity index improver may contain any (meth)acrylate structure unit or any structure unit derived from olefin or the like.

A preferable aspect concerning the PSSI of the second viscosity index improver, the weight-average molecular weight ($M_W$) thereof, the number-average molecular weight ($M_N$) thereof, the ratio ($M_W$/PSSI) of the weight-average molecular weight to the PSSI, the ratio ($M_W/M_N$) of the weight-average molecular weight to the number-average molecular weight, the viscosity-increasing ratio ΔKV40/ΔKV100 of the kinematic viscosity at 40° C. to the kinematic viscosity at 100° C., the viscosity-increasing ratio ΔHTHS100/ΔHTHS150 of the HTHS viscosity at 100° C. to the HTHS viscosity at 150° C., the content of the second viscosity index improver in the second lubricant oil composition is the same as that in the case of the first viscosity index improver according to the first embodiment.

As the viscosity index improver, in addition to the second viscosity index improver, the second lubricant oil composition can further contain ordinary non-dispersion type or dispersion type poly(meth)acrylates, non-dispersion type or dispersion type ethylene-α-olefin copolymers or hydrogenated products thereof, polyisobutylenes or hydrogenated products thereof, styrene-diene hydrogenated copolymers, styrene-maleic anhydride ester copolymers, and polyalkylstyrenes or the like.

In the second lubricant oil composition, in order to further enhance the fuel efficiency performance, a friction modifier selected from organic molybdenum compounds and ash-free friction modifiers can be contained.

Specific examples and preferable examples of organic molybdenum compounds that can be used in the second embodiment, and the content of organic molybdenum are the same as those in the case of the organic molybdenum compounds in the first embodiment, and duplicated description thereof will be omitted here.

Specific examples of the ash-free friction modifiers that can be used in the second embodiment and the content thereof are the same as those in the case of the ash-free friction modifiers in the first embodiment, and duplicated description thereof will be omitted here.

In order to further improve the performance, any additives usually used for the lubricant oil according to the purpose can be contained in the second lubricant oil composition. Examples of such an additive can include additives such as a metallic detergent, an ash-free dispersant, an antioxidant, a wear-resistant agent (or extreme-pressure agent), a corrosion inhibitor, a rust inhibitor, a pour-point depressant, an anti-emulsifier, a metal deactivator, an antifoaming agent. Specific examples and preferable examples of these additives and the content thereof are the same as those in the case of the first embodiment, and duplicated description thereof will be omitted here.

The ratio of the HTHS viscosity at 150° C. to the HTHS viscosity at 100° C. of the second lubricant oil composition needs to satisfy the condition represented by the following equation (A). At a ratio less than 0.50, a necessary low temperature viscosity and sufficient fuel efficiency performance may not be obtained:

$$\text{HTHS (150° C.)}/\text{HTHS (100° C.)} \geq 0.50 \quad \text{(A)}$$

wherein HTHS (100° C.) represents the HTHS viscosity at 100° C., and HTHS (150° C.) represents the HTHS viscosity at 150° C.

For the same reason, the HTHS (150° C.)/HTHS (100° C.) is more preferably not less than 0.51, still more preferably not less than 0.52, particularly preferably not less than 0.53, and most preferably not less than 0.54.

The HTHS viscosity at 150° C. of the second lubricant oil composition is not particularly limited, and is preferably not more than 3.5 mPa·s, more preferably not more than 3.0 mPa·s, still more preferably not more than 2.8 mPa·s, and particularly preferably not more than 2.7 mPa·s. The HTHS viscosity at 150° C. of the second lubricant oil composition is preferably not less than 2.0 mPa·s, more preferably not less than 2.1 mPa·s, still more preferably not less than 2.2 mPa·s, particularly preferably not less than 2.3 mPa·s, and most preferably not less than 2.4 mPa·s. At an HTHS viscosity at 150° C. less than 2.0 mPa·s, insufficient lubricating properties may be caused; at an HTHS viscosity at 150° C. more than 3.5 mPa·s, a necessary low temperature viscosity and sufficient fuel efficiency performance may not be obtained.

The HTHS viscosity at 100° C. of the second lubricant oil composition is not particularly limited, and is preferably not more than 5.3 mPa·s, more preferably not more than 5.2 mPa·s, still more preferably not more than 5.1 mPa·s, and particularly preferably not more than 5.0 mPa·s. The HTHS viscosity at 100° C. is preferably not less than 3.5 mPa·s, more preferably not less than 3.8 mPa·s, particularly preferably not less than 4.0 mPa·s, and most preferably not less than 4.2 mPa·s. At an HTHS viscosity at 100° C. less than 3.5 mPa·s, insufficient lubricating properties may be caused; at an HTHS viscosity at 100° C. more than 5.3 mPa·s, a necessary low temperature viscosity and sufficient fuel efficiency performance may not be obtained.

The kinematic viscosity at 100° C. of the second lubricant oil composition is preferably 3 to 15 $mm^2/s$, more preferably not more than 12 $mm^2/s$, still more preferably not more than 10 $mm^2/s$, particularly preferably not more than 9 $mm^2/s$, and most preferably not more than 8 $mm^2/s$. The kinematic viscosity at 100° C. of the lubricant oil composition according to the present invention is more preferably not less than 4 $mm^2/s$, still more preferably not less than 5 $mm^2/s$, particularly preferably not less than 6 $mm^2/s$, and most preferably not less than 7 $mm^2/s$. At a kinematic viscosity at 100° C. less than 3 $mm^2/s$, insufficient lubricating properties may be caused; at a kinematic viscosity at 100° C. more than 15 $mm^2/s$, a necessary low temperature viscosity and sufficient fuel efficiency performance may not be obtained.

The kinematic viscosity at 40° C. of the second lubricant oil composition is not particularly limited, and is usually 4 to 80 $mm^2/s$, preferably not more than 50 $mm^2/s$, more preferably not more than 45 $mm^2/S$, still more preferably not more than 40 $mm^2/s$, particularly preferably not more than 35 $mm^2/s$, and most preferably not more than 33 $mm^2/s$. The kinematic viscosity at 40° C. of the second lubricant oil composition is preferably not less than 10 $mm^2/s$, more preferably not less than 20 $mm^2/s$, still more preferably not less than 25 $mm^2/s$, and particularly preferably not less than 27 $mm^2/s$. At a kinematic viscosity at 40° C. less than 4 $mm^2/s$, insufficient lubricating properties may be caused; at a kinematic viscosity at 40° C. more than 80 $mm^2/s$, a necessary low temperature viscosity and sufficient fuel efficiency performance may not be obtained.

The viscosity index of the second lubricant oil composition is not particularly limited, and is preferably in the range of 140 to 400, more preferably not less than 180, still more preferably not less than 190, further still more preferably not less than 200, and particularly preferably not less than 210. At a viscosity index less than 140, it may be difficult to improve the fuel efficiency while the HTHS viscosity is kept, and further, it may be difficult to reduce the low temperature viscosity at −35° C. At a viscosity index more than 400, the low temperature fluidity is reduced, and further, malfunctions caused by insufficient solubility of the additive and adaptability to a sealing material may be caused.

The second lubricant oil composition is the one whose fuel efficiency, lubricating properties and high temperature detergency are high, and in which even if a synthetic oil such as a poly-α-olefin base oil and an ester base oil or a low viscosity mineral base oil is not used, the kinematic viscosities at 40° C. and 100° C. and HTHS viscosity at 100° C. of the lubricant oil are remarkably reduced, which is effective in improvement in fuel efficiency, while the HTHS viscosity is kept at a constant level. The second lubricant oil composition having such high properties can be suitably used as fuel-efficient engine oils such as fuel-efficient gasoline engine oils and fuel-efficient diesel engine oils.

EXAMPLES

Hereinafter, based on Examples and Comparative Examples, the present invention will be more specifically described, but the present invention will not be limited to Examples below.

Examples 1-1 and 1-2, Comparative Examples 1-1 to 1-3

In Examples 1-1 and 1-2 and Comparative Examples 1-1 to 1-3, a lubricant oil composition was prepared using a base oil and additives shown below. The properties of Base Oil 1-1 are shown in Table 1, and the properties of the lubricant oil composition are shown in Table 2.

(Base oil)

Base Oil 1-1: mineral oil obtained by hydrocracking/hydrogenation isomerization of an n-paraffin-containing oil (Additives)

A-1-1: polymethacrylate (M1a=40.13, M2a=1.73, M1a/M2a=23.15, ΔKV40/ΔKV100=2.3, ΔHTHS100/ΔHTHS150=1.51, MW=400,000, PSSI=27, Mw/Mn=3.0, Mw/PSSI=14800)

A-1-2: polymethacrylate (M1a=38.38, M2a=2.25, M1a/M2a=17.05, ΔKV40/ΔKV100=2.2, ΔHTHS100/ΔHTHS150=1.50, MW=400,000, PSSI=25, Mw/Mn=3.0, Mw/PSSI=16200)

A-1-3: dispersion type polymethacrylate (M1a=42.27, M2a=4.39, M1a/M2a=9.6, ΔKV40/ΔKV100=4.4, ΔHTHS100/ΔHTHS150=2.15, MW=80,000, Mw/Mn=2.7, PSSI=5, Mw/PSSI=16000)

A-1-4: dispersion type polymethacrylate (M1a=41.07, M2a=4.12, M1a/M2a=9.9, ΔKV40/ΔKV100=3.3, ΔHTHS100/ΔHTHS150=1.79, MW=300,000, Mw/Mn=4.0, PSSI=40, Mw/PSSI=7500)

A-1-5: styrene-diene copolymer (M1a=0, M1a/M2a=0, ΔKV40/ΔKV100=5.1, ΔHTHS100/ΔHTHS150=1.90)

B-1-1: glycerol monooleate

B-1-2: molybdenum dithiocarbamate

C-1-1: metal detergent, ash-free dispersant, antioxidant, wear-resistant agent, pour-point depressant, antifoaming agent, and the like.

TABLE 1

| | | Units | Base oil 1-1 |
|---|---|---|---|
| Density (15° C.) | | g/cm$^3$ | 0.825 |
| Kinematic viscosity (40° C.) | | mm$^2$/s | 17.8 |
| Kinematic viscosity (100° C.) | | mm$^2$/s | 4.07 |
| Viscosity index | | | 132 |
| Pour point | | ° C. | −22.5 |
| Aniline point | | ° C. | 119.1 |
| Iodine number | | | 0.06 |
| Sulfur content | | Mass ppm | <1 |
| Nitrogen content | | Mass ppm | <3 |
| n-d-M Analysis | % $C_P$ | | 87.3 |
| | % $C_N$ | | 12.7 |
| | % $C_A$ | | 0 |
| Separation by chromatography | Saturated content | % By mass | 99.6 |
| | Aromatic content | % By mass | 0.2 |
| | Resin content | % By mass | 0.2 |
| Evaporation amount (NOACK) 250° C., 1 h | | % By mass | 13.4 |

[Evaluation of Lubricant Oil Composition]

For each lubricant oil composition in Examples 1-1 and 1-2 and Comparative Examples 1-1 to 1-3, the kinematic viscosity at 40° C. and the kinematic viscosity at 100° C., the viscosity index, the HTHS viscosity at 150° C. and/or at 100° C., and the MRV viscosity at −35° C. were measured. The measurement of values of the respective physical properties was performed according to the following evaluation methods. The obtained result is shown in Table 2.

(1) Kinematic viscosity: ASTM D-445

(2) Viscosity index: JIS K 2283-1993

(3) HTHS viscosity: ASTM D-4683

(4) MRV viscosity: ASTM D-4684

TABLE 2

| | | | Example 1-1 | Example 1-2 | Comparative Example 1-1 | Comparative Example 1-2 | Comparative Example 1-3 |
|---|---|---|---|---|---|---|---|
| Base oil | Based on whole amount of composition | | | | | | |
| O-1 | Base oil 1-1 | % By mass | The rest | The rest | The rest | The rest | The rest |
| Additives | Based on whole amount of composition | | | | | | |
| A-1-1 | Polymethacrylate | % By mass | 16 | | | | |
| A-1-2 | Polymethacrylate | % By mass | | 15 | | | |
| A-1-3 | Polymethacrylate | % By mass | | | 10 | | |
| A-1-4 | Polymethacrylate | % By mass | | | | 9 | |
| A-1-5 | Styrene diene copolymer | % By mass | | | | | 24 |
| B-1-1 | Friction modifier1 | % By mass | 0.5 | 0.5 | 0.5 | 0.5 | 0.5 |
| B-1-2 | Friction modifier2 | % By mass | 0.3 | 0.3 | 0.3 | 0.3 | 0.3 |
| C-1-1 | Other additives | % By mass | 14 | 14 | 14 | 14 | 14 |
| | Evaluation result | | | | | | |
| Kinematic viscosity | 40° C. | mm$^2$/s | 45.2 | 43.8 | 54.0 | 57.2 | 71.3 |
| | 100° C. | mm$^2$/s | 10.9 | 10.9 | 10.8 | 12.9 | 13.2 |
| Viscosity index | | | 244 | 253 | 197 | 232 | 189 |
| HTHS viscosity | 100° C. | mPa·s | 6.3 | 6.4 | 7.6 | 7.4 | 7.5 |
| | 150° C. | mPa·s | 3.5 | 3.5 | 3.5 | 3.5 | 3.5 |

TABLE 2-continued

| | | | Example 1-1 | Example 1-2 | Comparative Example 1-1 | Comparative Example 1-2 | Comparative Example 1-3 |
|---|---|---|---|---|---|---|---|
| | HTHS150/HTHS100 | | 0.56 | 0.55 | 0.46 | 0.46 | 0.47 |
| MRV viscosity | −35° C. | mPa·s | 6300 | 6500 | 12000 | — | — |

As shown in Table 2, the lubricant oil compositions in Examples 1-1 and 1-2 and Comparative Examples 1-1 to 1-3 are those whose HTHS viscosities at 150° C. are approximately the same; compared to the lubricant oil compositions in Comparative Examples 1-1 to 1-3, the kinematic viscosity at 40° C. and the HTHS viscosity at 100° C. were lower, the viscosity index was higher, and the viscosity temperature properties were better in the lubricant oil compositions of Examples 1-1 and 1-2. From the result, it turns out that the lubricant oil composition according to the present invention is a lubricant oil composition in which the fuel efficiency is high; without using a synthetic oil such as a poly-α-olefin base oil and an ester base oil or a low viscosity mineral base oil, the fuel efficiency can be improved while the high temperature high shear viscosity at 150° C. is kept; particularly, the HTHS viscosity at 100° C. of the lubricant oil can be reduced, and the MRV viscosity at −40° C. can also be improved.

Examples 2-1 to 2-6, Comparative Examples 2-1 to 2-3

In Examples 2-1 to 2-6 and Comparative Examples 2-1 to 2-3, using the base oils and additives shown below, a lubricant oil composition having a composition shown in Table 4 was prepared, and evaluated as shown below. The properties of Base Oils 2-1 to 2-3 are shown in Table 3.

(Base Oils)

Base Oil 2-1: base oil obtained by hydrocracking/hydrogenation isomerization of an n-paraffin-containing oil Base Oil 2-2: hydrocracked base oil Base Oil 2-3: hydrocracked base oil (Additives)

A-2-1: non-dispersion type polymethacrylate (M1b=5.8, M2b=0.95, M1b/M2b=6.1, ΔKV40/ΔKV100=2.2, ΔHTHS100/ΔHTHS150=1.51, MW=400,000, PSSI=20, Mw/Mn=2.2, Mw/PSSI=20000)

A-2-2: non-dispersion type polymethacrylate (M1b=0.19, M2b=3.69, M1b/M2b=0.05, ΔKV40/ΔKV100=4.4, ΔHTHS100/ΔHTHS150=2.15, MW=80,000, Mw/Mn=2.7, PSSI=5, Mw/PSSI=16000)

A-2-3: dispersion type polymethacrylate (M1b=1.5, M2b=3.52, M1b/M2b=0.43, ΔKV40/ΔKV100=3.3, ΔHTHS100/ΔHTHS150=1.79, MW=300,000, PSSI=40, Mw/Mn=4.0, Mw/PSSI=7500)

B-2-1 (Friction Modifier 1): glycerin monooleate

B-2-2 (Friction Modifier 2): oleyl urea

B-2-3 (Friction Modifier 3): molybdenum dithiocarbamate

C-2-1 (Other additives): metallic detergent, ash-free dispersant, antioxidant, phosphorus wear-resistant agent, pour-point depressant, antifoaming agent and the like are contained

TABLE 3

| | | Units | Base oil 2-1 | Base oil 2-2 | Base oil 2-3 |
|---|---|---|---|---|---|
| Urea adduct value | | % by mass | 1.3 | 4.6 | 5.5 |
| Density (15° C.) | | g/cm$^3$ | 0.820 | 0.839 | 0.845 |
| Kinematic viscosity (40° C.) | | mm$^2$/s | 15.8 | 18.7 | 35.91 |
| Kinematic viscosity (100° C.) | | mm$^2$/s | 3.85 | 4.09 | 6.379 |
| Viscosity index | | | 141 | 120 | 130 |
| Pour point | | ° C. | −22.5 | −22.5 | −17.5 |
| Aniline point | | ° C. | 118.5 | 111.6 | 121.3 |
| Iodine number | | | 0.06 | 0.79 | 5.3 |
| Sulfur content | | Mass ppm | <1 | 2 | 6 |
| Nitrogen content | | Mass ppm | <3 | <3 | <3 |
| NOACK evaporation amount | | | 7.5 | 16.1 | 6.8 |
| n-d-M Analysis | % $C_P$ | | 93.3 | 78 | 78.4 |
| | % $C_N$ | | 6.7 | 20.7 | 21.1 |
| | % $C_A$ | | 0 | 1.3 | 0.5 |
| Separation by chromatography | Saturated content | Mass ppm | 99.6 | 95.1 | 93.3 |
| | Aromatic content | Mass ppm | 0.2 | 4.7 | 6.6 |
| Paraffin content based on saturated content | | Mass ppm | 87 | 51 | 49 |
| Naphthene content based on saturated content | | Mass ppm | 13 | 49 | 51 |

<Evaluation of Lubricant Oil Composition>

In each of the lubricant oil compositions of Examples 2-1 to 2-6 and Comparative Examples 2-1 to 2-3, the kinematic viscosity at 40° C., the kinematic viscosity at 100° C., the viscosity index, the HTHS viscosity at 100° C., the HTHS viscosity at 150° C., the CCS viscosity at −35° C., and the deposit amount in a panel coking test were measured. Each measurement was performed by the following evaluation methods. The result is shown in Table 4.

(1) Kinematic viscosity: ASTM D-445

(2) Viscosity index: JIS K 2283-1993

(3) HTHS viscosity: ASTM D4683

(4) CCS viscosity: ASTM D5293

(5) High temperature detergency test: using a panel coking tester, a test was performed under the condition of an oil temperature of 100° C., a panel temperature of 280° C., a splashing time of 3 hours, and ON/OFF cycle=15 s/45 s, and the amount (mg) of the deposit adhering to the panel was measured.

TABLE 4

| | | | Example 2-1 | Example 2-2 | Example 2-3 | Example 2-4 | Example 2-5 | Example 2-6 | Comparative Example 2-1 | Comparative Example 2-2 | Comparative Example 2-3 |
|---|---|---|---|---|---|---|---|---|---|---|---|
| Base oil | Based on whole amount of base oil | | | | | | | | | | |
| O-1 | Base oil 2-1 | % by mass | 80 | 70 | 80 | 0 | 70 | 100 | 80 | 0 | 0 |
| O-2 | Base oil 2-2 | % by mass | 0 | 0 | 0 | 100 | 30 | 0 | 0 | 100 | 100 |
| O-3 | Base oil 2-3 | % by mass | 20 | 30 | 20 | 0 | 0 | 0 | 20 | 0 | 0 |
| | Base oil viscosity (100° C.) | $mm^2/s$ | 4.2 | 4.4 | 4.2 | 4.1 | 3.9 | 3.9 | 4.2 | 4.1 | 4.1 |
| Additives | Based on whole amount of composition | | | | | | | | | | |
| A-2-1 | Polymethacrylate 1 | % by mass | 10.1 | 9.4 | 10.2 | 10.7 | 11.4 | 12.4 | | | |
| A-2-2 | Polymethacrylate 2 | % by mass | | | | | | | | | 5.3 |
| A-2-3 | Polymethacrylate 3 | % by mass | | | | | | | 4.6 | 4.8 | |
| B-2-1 | Friction modifier 1 | % by mass | 1 | 1 | | 1 | 1 | 1 | 1 | 1 | 1 |
| B-2-2 | Friction modifier 2 | % by mass | 0.3 | 0.3 | | 0.3 | 0.3 | 0.3 | 0.3 | 0.3 | 0.3 |
| B-2-3 | Friction modifier 3 | % by mass | | | 0.5 | | | | | | |
| C-2-1 | Other additives | % by mass | 13 | 13 | 13 | 13 | 13 | 13 | 13 | 13 | 13 |
| Evaluation result | | | | | | | | | | | |
| Kinematic viscosity | 40° C. | $mm^2/s$ | 32 | 33 | 32 | 33 | 30 | 29 | 37 | 41 | 38 |
| | 100° C. | $mm^2/s$ | 7.5 | 7.5 | 7.5 | 7.7 | 7.5 | 7.7 | 8.4 | 8.8 | 7.7 |
| Viscosity index | | | 217 | 211 | 219 | 214 | 229 | 250 | 212 | 202 | 177 |
| HTHS viscosity | 100° C. | mPa · s | 4.8 | 4.9 | 4.8 | 4.8 | 4.7 | 4.6 | 5.3 | 5.4 | 5.3 |
| | 150° C. | mPa · s | 2.6 | 2.6 | 2.6 | 2.6 | 2.6 | 2.6 | 2.6 | 2.6 | 2.6 |
| HTHS viscosity (150° C.)/HTHS viscosity (100° C.) | | | 0.54 | 0.53 | 0.54 | 0.54 | 0.55 | 0.57 | 0.49 | 0.48 | 0.49 |
| CCS viscosity | −35° C. | mPa · s | 4000 | 4400 | 4000 | 6700 | — | — | — | — | — |
| Deposit amount in high temperature detergency test | | mg | 80 | 65 | 85 | 210 | 200 | — | — | — | — |

From Table 4, in the compositions of Examples 2-1 to 2-6 to which a predetermined viscosity index improver is added, the viscosity temperature properties and low temperature viscosity properties are high. Further, in the compositions of Examples 2-1 to 2-3 with which a high viscosity base oil whose kinematic viscosity at 100° C. is 5 to 500 $mm^2/s$ is blended, the deposit amount is small, and the high temperature detergency is high. Contrary to this, in the compositions of Comparative Examples 2-1 to 2-3 to which a viscosity index improver other than the predetermined viscosity index improver is added, the kinematic viscosity (40° C.) and the HTHS viscosity (100° C.) are high, and the viscosity temperature properties are poor.

The invention claimed is:

1. A lubricant oil composition comprising:

a lubricant base oil whose kinematic viscosity at 100° C. is 1 to 20 $mm^2/s$; and a viscosity index improver in which a ratio M1a/M2a of a total area M1a of peaks in a chemical shift between 29-31 ppm to a total area M2a of peaks in a chemical shift between 64-69 ppm based on a total area of all peaks is not less than 10 in a spectrum obtained by $^{13}$C-NMR, wherein a ratio of an HTHS viscosity of the lubricant oil composition at 150° C. to an HTHS viscosity of the lubricant oil composition at 100° C. satisfies a condition represented by a following equation (A):

$$\text{HTHS (150° C.)/HTHS (100° C.)} > 0.50 \quad \text{(A)}$$

wherein HTHS (100° C.) represents the HTHS viscosity of the lubricant oil composition at 100° C., and HTHS (150° C.) represents the HTHS viscosity of the lubricant oil composition at 150° C.

2. The lubricant oil composition according to claim 1, wherein the viscosity index improver is a poly(meth)acrylate viscosity index improver.

3. The lubricant oil composition according to claim 1, wherein the viscosity index improver is a viscosity index improver whose PSSI is not more than 40, and a ratio of a weight-average molecular weight to the PSSI is not less than $1\times10^4$.

4. The lubricant oil composition according to claim 1, further comprising at least one compound selected from organic molybdenum compounds and ash-free friction modifiers.

5. A lubricant oil composition comprising:

a lubricant base oil whose kinematic viscosity at 100° C. is 1 to 5 $mm^2/s$; and a viscosity index improver in which a ratio M1b/M2b of a total area M1b of peaks in a chemical shift between 51-52.5 ppm to a total area M2b of peaks in a chemical shift between 64-66 ppm based on a total area of all peaks is not less than 1.0 in a spectrum obtained by $^{13}$C-NMR, wherein a ratio of an HTHS viscosity of the lubricant oil composition at 150° C. to an HTHS viscosity of the lubricant oil composition at 100° C. satisfies a condition represented by a following equation (A):

$$\text{HTHS (150° C.)/HTHS (100° C.)} \geq 0.50 \quad \text{(A)}$$

wherein HTHS (100° C.) represents the HTHS viscosity of the lubricant oil composition at 100° C., and HTHS (150° C.) represents the HTHS viscosity of the lubricant oil composition at 150° C.

6. The lubricant oil composition according to claim 5, wherein the viscosity index improver is a poly(meth)acrylate viscosity index improver.

7. The lubricant oil composition according to claim 5, wherein the viscosity index improver is a viscosity index improver whose PSSI is not more than 40, and a ratio of a weight-average molecular weight to the PSSI is not less than $0.8\times10^4$.

8. The lubricant oil composition according to claim 5, wherein the HTHS viscosity at 150° C. is not less than 2.6, and the HTHS viscosity at 100° C. is not more than 5.3.

* * * * *